US011779096B2

(12) United States Patent
Zheng et al.

(10) Patent No.: US 11,779,096 B2
(45) Date of Patent: Oct. 10, 2023

(54) COSMETIC PACKAGE

(71) Applicant: APR Beauty Group, Inc., Toronto (CA)

(72) Inventors: Min-Yan Zheng, Toronto (CA); Feng-Ying Fu, Toronto (CA)

(73) Assignee: APR Beauty Group, Inc., Toronto (CA)

( * ) Notice: Subject to any disclaimer, the term of this patent is extended or adjusted under 35 U.S.C. 154(b) by 289 days.

(21) Appl. No.: 17/219,300

(22) Filed: Mar. 31, 2021

(65) Prior Publication Data

US 2021/0315362 A1 Oct. 14, 2021

(30) Foreign Application Priority Data

Apr. 13, 2020 (IN) ..... 202011015938
Jun. 19, 2020 (IN) ..... 202011025899

(51) Int. Cl.
*A45D 40/24* (2006.01)
*A45D 40/26* (2006.01)
*A45D 40/22* (2006.01)

(52) U.S. Cl.
CPC ..... *A45D 40/24* (2013.01); *A45D 40/221* (2013.01); *A45D 40/264* (2013.01); *A45D 40/265* (2013.01)

(58) Field of Classification Search
CPC ..... A45D 2200/25; A45D 2200/05; A45D 40/24; A45D 2040/0012; A45D 2034/007; A45D 33/18
See application file for complete search history.

(56) References Cited

U.S. PATENT DOCUMENTS 2,073,377 A * 3/1937 Morris ..... A47K 5/1201 401/260
2,547,971 A * 4/1951 Polin ..... A45D 33/28 132/297
3,132,652 A 5/1964 Gazdik
5,301,808 A * 4/1994 Pierson ..... A45D 40/24 132/297

FOREIGN PATENT DOCUMENTS

EP 0238208 A2 * 9/1987 ..... A45D 40/18
EP 0610639 B1 4/1997
EP 1347697 B1 8/2004

OTHER PUBLICATIONS

Acxess Spring, Spring Diameter Change, 2023 (Year: 2023).*

* cited by examiner

*Primary Examiner* — Amy R Sipp
*Assistant Examiner* — Sydney J Pulvidente
(74) *Attorney, Agent, or Firm* — Jason Lee DeFrancesco

(57) ABSTRACT

A cosmetic package for a cosmetic, a care or pharmaceutical product which can be applied onto keratinous substrates such as skin, lips, under eyes, eyelids, cheeks, or eyebrows or any other part of the body. The cosmetic package comprises a base, a pivot frame connected to the base, and a plurality of cosmetic containers. The plurality of cosmetic containers has a plurality of reservoirs and a plurality of applicators removably coupled to the respective plurality of reservoirs. The pivot frame is configured to have a closed position and at least one open position. In the open position of the pivot frame, caps of the plurality of applicators can be disengaged from the respective plurality of reservoirs. In a closed position of the pivot frame, the pivot frame prevents the caps of the plurality of applicators from disengaging from the respective plurality of reservoirs.

20 Claims, 16 Drawing Sheets

COSMETIC PACKAGE

This application claims priority under 35 U.S.C. § 119 to Indian Provisional Patent Application No. 202011015938, filed on Apr. 13, 2020, and Indian Provisional Patent Application No. 202011025899, filed on Jun. 19, 2020. The disclosure of each of these applications is incorporated herein by reference.

BACKGROUND

Field

The present disclosure relates generally to a cosmetic package and, more particularly, to a cosmetic package with a pivot frame.

Description of the Related Art

Cosmetic packages are known in the art to allow for housing and dispensing of a cosmetic product. Most cosmetic packages provide a container having a reservoir for housing the product, an applicator that can be inserted and stored in the reservoir, and an outlet where the cosmetic product is dispensed. In many cases, the applicator includes a cap that can be secured to the outlet using threads such as a screw thread or a single thread such as a ridge wrapped around a cylinder.

A cosmetic package is described in EP1347697B1 in which the securing mechanism between the reservoir and the applicator is based on a latch-bead-connection. In order to seal the storage container so as to be leak-proof, the closure cap of the applicator part in this embodiment of the cosmetics unit is placed very tightly on the storage container.

Furthermore, EP0610639B1 discloses a cosmetic unit with another securing mechanism. A large swiveling clamp is rotatably mounted on an applicator. In order to secure the applicator in the closed position, the swiveling clamp can be swiveled about an entire storage container and latched at the underside of the storage container.

It is important in the cosmetic industry to provide a cosmetic package for cosmetic product which not only protects the dispensing container but also secures the applicator to the reservoir when the applicator is being stored and is not in use.

A cosmetic package that offers multiple cosmetics in a single package such as a cosmetic palette typically has the cosmetics provided in cosmetic containers that are spaced from each other and integral with the cosmetic package. Typically, it is not possible to replace cosmetic containers in the cosmetic package. Consumers generally have a preference for certain colors and if a consumer does not like a particular color or cosmetic, he or she cannot replace it with a more desirable one. As a result, the preferred colors/cosmetic are utilized more often and depleted faster. To replenish the preferred cosmetic, it will be necessary to replace the entire cosmetic package because the cosmetic containers are integrally attached to the cosmetic package making it impossible to replace individual cosmetic containers. To avoid having to replace the entire cosmetic package, it would be desirable to have a cosmetic package with cosmetic containers, each of which can be individually replenished when finished. Furthermore, the replaceable cosmetic containers would allow the users to include only preferred cosmetics in the cosmetic package.

Thus, there is a need for a customizable cosmetic package that securely contains multiple discrete cosmetic containers and enables a user to easily remove a single cosmetic container without the risk of accidentally removing the other cosmetic containers, and which also allows consumers to have select a complete array of desired cosmetics. Additionally, there is also a need to provide a cosmetic container which not only protects the cosmetic containers but also secures the caps and/or the applicators to their corresponding reservoirs when the applicators are being stored and are not in use.

SUMMARY

It is an object of the present disclosure to provide a cosmetic package that can be easily configured to contain a product and a cosmetic applicator.

Accordingly, there is provided a cosmetic package comprising, a base having at least one reservoir for accommodating at least one cosmetic or a care product therein, at least one cap to be removably associated with said base to seal the at least one reservoir when not in use, and a pivot frame rotatably attached to the base. The cosmetic package may include at least one applicator comprises the cap configured to lock on a neck portion of the at least one reservoir. The pivot frame is configured to have one closed position and at least one open position. In the open position of the pivot frame, the pivot frame is at a non-zero angle with respect to a vertical axis of the base and in the open position, the at least one applicator can be disengaged from the base by pushing in a release button present in the cap. In the closed position of the pivot frame, the pivot frame is at a zero degree angle with respect to a vertical axis the base. In the closed position of the pivot frame, the pivot frame covers at least a top side of the cap without contacting the cap such that there is a minuscule gap between the cap and the pivot frame which prevents an axial movement of the at least one applicator in an upward direction and ensuring that the at least one applicator is not able to pop out from the at least one reservoir in the event of an accidental actuation.

According to a first embodiment of the present disclosure, there is provided a cosmetic package comprising a base having a plurality of reservoirs and wherein each the plurality of reservoirs accommodates a cosmetic or a care product therein. The plurality of reservoirs is configured to hold a plurality of applicators such that each of the plurality of the reservoirs holds one of a respective applicator of the plurality of the applicators.

According to an aspect of the first disclosure, the base includes the plurality of reservoirs that are integrally formed and unitary with the base. In alternate embodiments the plurality of reservoirs may not be integrally formed and may not be unitary with the base.

According to an aspect of the present disclosure, at least two cosmetic products housed in the respective ones of the plurality of reservoirs may be different from each other and/or at least two applicators of the plurality of the applicators housed in the respective ones of the plurality of reservoirs may be different from each other. The cosmetic product may be including, but not limited to lipstick, lip gloss, mascara, concealer, facial cream and nail polish etc. The cosmetic package thus can selectively hold a variety of cosmetic products having different components or colors, or various applicators having different materials or forms.

According to an aspect of the present disclosure, each of the plurality of applicators has a rod, an applicator tip attached to a distal end of the rod, and a cap at a proximal end of the rod. When each of the plurality of applicators is positioned in the corresponding of the plurality of reservoirs and the caps of the plurality of applicators seal the corresponding plurality of neck portions of the plurality of reservoirs and the corresponding applicator tips from the external environment.

According to a preferred embodiment of the present disclosure, the plurality of reservoirs of the base is identical to one another and is regularly spaced from one another while extending parallel to one another. In alternate embodiments, however, the plurality of reservoirs may not be identical to one another in terms of shape or size and may not be regularly spaced from one another.

According to an embodiment of the present disclosure, a collar is fitted over the proximal end of the base. The collar defines the plurality of neck portions of the plurality of reservoirs. Each of the plurality of reservoirs of the base has an opening at a proximal end of the base and wherein each of the plurality of the neck portions has an orifice corresponding to one of the openings of the reservoirs of the base such that the plurality of neck portions fits over the openings of the plurality of reservoirs. The orifices of the collar are in communication with the corresponding openings of the plurality of the reservoirs of the base.

In other embodiments, the plurality of neck portions are unitary with the plurality of reservoirs.

In a preferred first embodiment, the collar is sonic welded with the base so as to be substantially integral with the base. In alternate embodiments, however, the base and collar can be separately formed and attached to one another via an adhesive, snap fit, or any other suitable coupling means known in the art. The base may be constructed from metal, plastic, ceramic, glass, or any combination thereof or a suitable material known in the art. The base in a preferred embodiment is made from a material that imparts transparency so that the cosmetic products stored in the reservoirs may be visible to a user.

As described above, in the manufacturing of the cosmetic package, the connection between the base and the collar can be formed integral by applying a processing method such as double injection, ultrasonic bonding, printing or any other suitable method known in art. It is possible that the base and the collar may have different materials, colors, and transparencies. In a preferred embodiment, when the base is made of a material having transparency, the collar may be formed of an opaque material or vice versa. However, in alternate embodiments, the base and the collar may be made of a material that imparts opaqueness.

Further, the plurality of applicators is secured to the base via the collar. The orifices of the collar are shaped to receive the respective plurality of applicators which can be used to apply the cosmetic product(s) from the reservoirs to an external surface such as skin or hair. According to certain example aspects of the disclosure, a wiper may be inserted into at least one of the orifices of the collar such that the wiper can remove excess cosmetic product from the applicator tip of the associated applicator.

According to an aspect of the present disclosure, each reservoir along with its respective neck portion and respective applicator constitutes a cosmetic container.

According to yet another aspect of the present disclosure, the pivot frame includes a back wall, a top wall, a left sidewall and a right sidewall. The pivot frame is rotatably attached to the base through a pair of recesses and a pair of protrusions such that the pair of recesses in the pivot frame can mate with the pair of protrusions on the opposite sides of the base. More particularly, inner surfaces of the left sidewall and the right sidewall of the pivot frame include the pair of recesses that mate with the corresponding pair of protrusions on outer surface of a left and a right side of the base. Alternatively, the pair of recesses may be positioned on the base and the pair of protrusions on the pivot frame. Other methods and apparatus known to those of ordinary skill in the art for rotatably attaching the pivot frame to the base e.g., hinges like mechanical or living hinges are also possible and may be used; the examples disclosed herein are not limiting.

According to aspects of the present disclosure, the pivot frame may rotate over a range of about 90 degrees or greater with respect to the base. For example, when the pivot frame is in an open position, the pivot frame rotates more than 90 degrees but less than 180 degrees with respect to a vertical axis of the base. When the pivot frame is in a closed position, the pivot frame may be parallel or in-line with the vertical axis of the base. In certain example aspects, when the pivot frame is in the closed position, the pivot frame covers the proximal end of the base so as to house the plurality of caps of the plurality of applicators within a cavity of the pivot frame.

In the closed position, the pivot frame provides protection to a top side of the base. In certain example aspects, the pivot frame protects substantially the entire an upper left edge, an upper right edge and the top side of the base. More particularly, in the closed position, the pivot frame encloses the plurality of caps of the plurality of applicators from four sides of the cosmetic package, namely from a top side, a back side, a left side and a right side of the cosmetic package by the top wall, the back wall, the left sidewall and the right sidewall of the pivot frame respectively. In the closed position, the plurality of caps of the plurality of applicators is visible from a front side of the cosmetic package. In this position, the top wall of the pivot frame extends over the plurality of caps of the plurality of applicators without abutting them i.e. a gap exists between the top wall of the pivot frame and the plurality of caps of the plurality of applicators which is sufficiently small enough so that the pivot frame is able to prevent the plurality of applicators from dislodging from the cosmetic package by restricting axial movement of the plurality of applicators, upon accidental actuation in the closed position of the cosmetic package.

Further, according to an embodiment of the present disclosure, the cosmetic package includes a means that allows the pivot frame to rest at two different angular positions with respect to the base. The means includes a pair of projections on both the upper left edge and the upper right edge of the base, and a pair of bumps on inner surfaces of the left sidewall and the right sidewall of the pivot frame. The pair of protrusions on each of the upper left edge and the upper right edge of the base are spaced radially. A first resting position of the pivot frame with respect to the base corresponds to the closed position of the pivot frame, where the pivot frame is at a substantially zero angle with the vertical axis of the base. When the pivot frame is rotated in order to open the cosmetic package, the pair of bumps of the pivot frame overrides one of the respective pair of projections of the base so that the pivot frame is able to pivot about the vertical axis of the base till it overrides the other of the respective pair of projections of the base to be locked in a second resting position in which the pivot frame is at a non-zero angle with respect to the vertical axis of the base. The non-zero angle may be selected from a range of 120 degrees-160 degrees. In a preferred embodiment, the second resting position of the pivot frame is at substantially 145 degrees angle with respect to the vertical axis of the base. In alternate embodiments, one or more means may be provided so that the pivot frame may be at rest with respect to base in more than two positions.

When the pivot frame is in the open position, one or more applicators of the plurality of the applicators may be removed from the corresponding reservoirs to apply the cosmetic product from the reservoirs.

According to an aspect of the present disclosure, after pivot frame is moved to the open position, the user can quickly remove or put on the caps with a single hand without the need of turning the caps. More particularly, the base, the collar, and/or the plurality of applicators are threadless.

According to an aspect of the present disclosure, each of the plurality of caps comprises a cap body adapted to be detachably fitted around the respective neck portion of the collar. The cap body comprises a top wall and at least one sidewall extending downwardly from the top wall. The cap body receives the proximal end of the rod of the applicator in inner side of the cap body. The proximal end of the rod includes a spring support seat which at its bottom end carries a plug having a substantially truncated inverted conical outer surface and adapted to be seated conformingly on an upper edge of the respective neck portion of the collar. A spring is mounted in the spring support seat such that it extends between the top wall of the cap body and the spring support seat in a compressed state to bias the plug downwardly. The spring support seat is in sliding contact with the inner wall of the cap body. A stopper is provided at a distal end of the cap body which is coupled to an inner surface of the cap body at the distal end of the cap body and with the rod, in order to prevent the plug from getting out of the cap body.

Furthermore, the cap body includes an elastic member mounted to the inner surface of the cap body near its distal end. When the cap body is pushed onto the neck portion of the collar the elastic member is annular and can pass over a cylindrical rim portion of the respective neck portion and after passing the cylindrical rim portion, it engages a conical portion of the neck portion which is stepped in from the cylindrical rim portion, thereby preventing the cap body from being pulled out of the respective neck portion of the collar. The cap further includes a release button as a disengaging means attached with the elastic member provided near the distal end of the cap body. By pushing in the release button, the elastic member disengages from the neck portion of the collar. However, in alternate embodiments, the release button and the elastic member may or may not be integrally attached.

In a rested state, the elastic member has a substantially oval or fusiform cross-section (not shown) with its major axis substantially larger than a diameter of the cylindrical rim portion of the neck portion of the collar and its minor axis is smaller than the diameter of the cylindrical rim portion of the neck portion of the collar. When elastically deformed to a substantially circular shape, the inner diameter of the elastic member will be larger than the diameter of the cylindrical rim portion of the neck portion of the collar.

According to an aspect of the present disclosure, the elastic member and the release button may be made of a resilient metal or a hard and elastic synthetic resin. The release button is slidably received in a radial through hole formed in the at least one sidewall of the cap.

In an unstressed state, the elastic member engages the conical portion of the neck portion of the collar, keeping the cap from coming off the base. When the release button is pushed in by pressing, the elastic member is compressed from both ends of its major axis and deformed into a substantially circular shape having a larger diameter than the diameter of the cylindrical rim portion of the neck portion of the collar. In this state, the elastic member disengages from the conical portion of the neck portion of the collar. The cap is thus spontaneously pushed up by the force of the spring, thus popping out of the respective applicator in a vertical upward direction provides a visual indicator to a user that the respective applicator is now unlocked from the base. Thus, the cap can be removed from the neck portion of the base simply by pushing in the release button with one finger. When the finger is released from the release button, the elastic member will return to its original oval shape by its own resiliency.

Thus, the cosmetic package includes a two-step lock to secure the plurality of applicators with the base. In the first step, the plurality of caps of the respective plurality of the applicators engages with the respective conical portions of the respective neck portions by the respective elastic members. In the second step, the pivot frame is brought into its first resting position where the pivot frame covers the plurality of caps at least from a top side without abutting the plurality of caps such that a minuscule gap is present between the plurality of caps and the pivot frame which prevents each of the plurality of applicators from being popped out from the respective plurality of reservoirs in the base.

In the open position, the pivot frame may act as a stand which supports the base in a slanted upright position.

According to an aspect of the disclosure, the cosmetic package include a base with six reservoirs and respective six applicators. In other alternate embodiments, the number of reservoirs and/or applicators may be more or less than six.

In certain example aspects, the cosmetic package may have a cosmetic of one type and/or color in one reservoir and a cosmetic of a different type and/or color in the other reservoir.

According to a second embodiment of the present disclosure, a cosmetic package comprise a base, a pivot frame and a plurality of cosmetic containers that are removably secured to the base. Each of the plurality of cosmetic containers accommodates a cosmetic or a care product therein. The plurality of cosmetic containers is removable which enables a user to change the order of the plurality of cosmetic containers on the base. Moreover, an individual cosmetic container may be replaced without the need to replace the entire base. The base is reusable and when a cosmetic container is depleted, a new cosmetic container can be provided in the base. This enables a user to change out the plurality of cosmetic containers held within the cosmetic package, for example, to customize the particular variety of cosmetic products held within the cosmetic package at a given time. Further, the plurality of cosmetic containers may or may not be configured to hold a corresponding applicator In an embodiment, each of the plurality of the cosmetic containers are substantially square in cross sectional profile. As will be clear to one of skill in the art, the cosmetic containers may have any other profile.

According to the second embodiment, the base includes a vertically extending back wall, a left sidewall and a right sidewall. The left sidewall and the right sidewall extend substantially perpendicularly from a front surface of the back wall of the base. The base comprises a plurality of receiving openings for receiving the plurality of cosmetic containers. The front face of the back wall further includes a plurality of partition walls extending substantially perpendicularly therefrom. The plurality of partition walls are arranged and spaced in a manner so as to define the receiving openings for holding the plurality of cosmetic containers in the base. In other words, each of the plurality of receiving openings is a space between by two adjacent partition walls which is separated horizontal direction by the front surface of the back wall of the base.

Further, each such receiving opening is dimensioned to receive a cosmetic container and has a width corresponding to a width of the corresponding cosmetic container. Further, the width of each of the plurality of receiving openings is substantially equivalent. Thus, a user may rearrange the plurality of cosmetic containers (which are all substantially equal in size) as desired. In an alternative embodiment, different sizes of the cosmetic containers may be used, for example by having different spacing between the various partition walls forming the different sizes of the plurality of receiving openings in the base.

The base detachably engages the plurality of cosmetic containers on the front face of its back wall. In a preferred embodiment, the base is adapted for securing six cosmetic containers at the front face of its back wall and includes twelve partition walls extending from the front face of the back wall. It is to be understood that the present disclosure is not limited to the embodiments depicted and can be modified to accommodate any number of cosmetic containers and any number of the partition walls.

According to an aspect of the present disclosure, at least one of the plurality of cosmetic containers includes a reservoir and a corresponding applicator associated with said reservoir. The applicator further comprises a rod, an applicator tip attached to a distal end of the rod, and a cap attached to a proximal end of the rod. When applicator is positioned in the corresponding reservoir, the cap seals the corresponding reservoir and the corresponding applicator tip from an external environment. The cap retains the rod for dipping the applicator tip, which is fixed to the distal end of the rod, into a volume of the cosmetic product retained within the reservoir. The applicator tip of the cosmetic container can, for example, comprise a flocked member, a brush, or any other structure capable of retrieving the cosmetic product from the inner volume of the reservoir and applying the cosmetic product to a body surface of a user, such as the user's lips, eyebrows, or eyelashes. The cosmetic container can be sealed during periods of nonuse by an engagement between the cap and a neck portion of the reservoir.

According to another aspect of the present disclosure, each of the reservoir of the cosmetic containers include at least two opposing recesses on two opposing sidewalls of the reservoir. Each of the opposing recesses of the reservoir is sized so as to accommodate the corresponding partition wall. In other words, the at least two opposing recesses on the two opposing sidewalls of the reservoir dimensioned to receive the two adjacent partition walls of the base when the cosmetic container is inserted into the receiving opening provided in the base.

The cosmetic containers are preferably releasably secured to the base, more particularly to the partition walls, to allow removal of the cosmetic containers from the base, when desired.

According to an aspect of the present disclosure, the dimensions of the plurality of the receiving openings are preferably substantially the same as the reservoirs of the plurality of cosmetic containers to allow the plurality of cosmetic containers to be snap fit or press fit into the corresponding plurality of receiving openings. The plurality of cosmetic containers and the base are made of a compliant material to facilitate the snap fit of the plurality of cosmetic containers into the corresponding plurality of receiving openings of the base.

To ensure that the plurality of cosmetic containers is securely retained in the corresponding plurality of receiving openings, each of the partition walls are preferably provided with a snap protrusion both on an upper edge a and a lower edge of the partition wall and each of the reservoir of the plurality of cosmetic containers is provided with a corresponding snap groove in each of the two opposing recesses at an upper edge a and a lower edge thereof. The snap grooves on the reservoir of the cosmetic containers is configured to mate with snap protrusions on the partition walls of the base for establishing a readily attachable and detachable snap-connection between the plurality of cosmetic containers and the base, when the plurality of cosmetic containers are snap fit into the corresponding plurality of receiving openings provided in the base.

To install a cosmetic container in the base, the cosmetic container is aligned with the respective receiving opening and then pushed into the receiving opening such that the partition walls associated with said receiving opening are received in the opposing recesses on the two opposing sidewalls of the reservoir of the cosmetic container and the cosmetic container snap fit into the receiving opening because of the mating of snap protrusions of the partition walls with the snap grooves provided on the reservoir of the cosmetic container. In the embodiment shown, the partition walls substantially flush with the two opposing sidewalls of the reservoir of the cosmetic container when the cosmetic container is located in the base.

To release or remove a single desired cosmetic container, a user holds the individual cosmetic container and applies pulling pressure to the cosmetic container towards the front direction so that the snap protrusions of the partition walls disengage from the snap grooves of the cosmetic container.

The present disclosure is not intended to be limited to snap protrusions and snap grooves described herein. Rather, other known detachable means may be used that detachably engage the plurality of cosmetic containers from the base.

Further, in an embodiment, the cosmetic package may contain decorative or informational matter over a portion of a back surface on the back wall of the base, such as a manufacturer's name or logo or instructions for use of the cosmetics held within the cosmetic containers.

According to yet another aspect of the present disclosure, an individual reservoir comprises a cosmetic storage portion and a collar. The cosmetic storage portion has an opening at a proximal portion of the reservoir and the collar is fitted over the opening of the cosmetic storage portion, and wherein the collar includes a neck portion having an orifice. The neck portion of the collar fits over the opening of the cosmetic storage portion of the reservoir. The orifice of the collar is in communication with the corresponding opening of the cosmetic storage portion of the reservoir.

According to certain example aspects of the disclosure, a wiper may be inserted into the orifice of the collar such that the wiper can remove excess cosmetic product from the applicator tip of the associated applicator. When the applicator tip is dipped in the cosmetic storage portion of the reservoir, it becomes loaded with the cosmetic product. The rod and the applicator tip are then withdrawn from the reservoir, the wiper removes the excess cosmetic product from the applicator tip and the rod.

In a preferred embodiment, the collar is sonic welded with the cosmetic storage portion so as to be substantially integral with the cosmetic storage portion of the reservoir. In alternate embodiments, however, the cosmetic storage portion and the collar can be separately formed and attached to one another via an adhesive, snap fit, or any other suitable coupling means known in the art. In yet alternate embodiment, the collar comprising the neck portion may be formed integrally with the cosmetic storage portion by using a single material or more than one material. In manufacturing of the cosmetic package, the connection between the cosmetic storage portion and the collar can be formed integral by applying a processing method such as double injection, ultrasonic bonding, printing or any other suitable method known in art. It is possible that the cosmetic storage portion and the collar may have different materials, colors, and transparencies. In a preferred embodiment, when the cosmetic storage portion is made of a material having transparency, the collar may be formed on an opaque material or vice versa. However, in alternate embodiments, the cosmetic storage portion and the collar may be made of a material that imparts opaqueness.

The cosmetic storage portion of the reservoir may be constructed from metal, plastic, ceramic, glass, or any combination thereof or a suitable material known in the art. The cosmetic storage portion of the reservoir in a preferred embodiment is made from a material that imparts transparency so that the cosmetic products stored in the reservoirs may be visible to a user. In one embodiment of the disclosure, the cosmetic containers and the base are constructed of plastic material.

Further, the pivot frame is rotatably attached to the base. According to an aspect of the disclosure, the pivot frame may rotate over a range of about degrees or greater. For example, when the pivot frame is in an open position, the pivot frame rotates degrees with respect to a vertical axis of the base. When the pivot frame is in a closed position, the pivot frame may be parallel or in-line with the vertical axis of the base. In certain example aspects, when the pivot frame is in the closed position, the pivot frame covers the proximal end of the base so as to cover the plurality of cosmetic containers from their top.

According to yet another aspect of the second embodiment, the pivot frame includes a top wall, a left sidewall and a right sidewall. The pivot frame is rotatably attached to the base through a pair of recesses and a pair of protrusions such that the pair of recesses in the pivot frame can mate with the pair of protrusions on the opposite sides of the base. More particularly, inner surfaces of the left sidewall and the right sidewall include the pair of recesses that mate with the corresponding pair of protrusions on the outer surfaces of the left sidewall and the right sidewall of the base. Alternatively, the pair of recesses may be positioned in the base and the pair of protrusions is positioned in the pivot frame. Other means known to those of ordinary skill in the art for rotatably attaching the pivot frame to the base e.g., hinges like mechanical or living hinges are also possible and may be used; the examples disclosed herein are not limiting.

In various alternate embodiments, the pivot frame may have a back wall or not but comprises at least a top wall, a left side wall and a right sidewall.

The pivot frame is configured to have a closed position and at least one open position. In the open position of the pivot frame, the plurality of cosmetic containers are accessible for use or can be disengaged from the base. In a closed position of the pivot frame, the pivot frame prevents accidental opening of the plurality of the cosmetic containers from the base.

In the closed position, the pivot frame provides protection to at least a top side of the base. In the closed position, the pivot frame surrounds a plurality of caps of the plurality of cosmetic containers from a top side, a left side and a right side of the cosmetic package by the corresponding top wall, the left sidewall and the right sidewall of the pivot frame. In the closed position, the plurality of caps of the plurality of cosmetic containers is visible from the front side of the cosmetic package. The top wall of the pivot frame extends over the plurality of caps without abutting them i.e. a gap exists between the inner surface of the top wall of the pivot frame and the outer surfaces of the plurality of caps of the plurality of cosmetic containers which is sufficiently small enough so that the pivot frame is able to prevent the plurality of applicators from dislodging from the cosmetic package by restricting axial movement of the plurality of applicators, upon accidental actuation in the closed position of the cosmetic package.

The cosmetic package includes a means that allows the pivot frame to rest at an angular position with respect to the base. The means includes projections on outer surfaces of both the left sidewall and the right sidewall of the base, and a pair of bumps on inner surfaces of the left sidewall and the right sidewall of the pivot frame. A first resting position of the pivot frame with respect to the base corresponds to the closed position of the pivot frame where the pivot frame is at a substantially zero angle with the vertical axis of the base. When the pivot frame is rotated in order to open the cosmetic package, the pair of bumps of the pivot frame overrides the respective pair of projections a of the base and the pivot frame thus pivots about the vertical axis and locks in a second resting position in which the pivot frame is at a non-zero angle with respect to the vertical axis of the base. In a preferred embodiment, the pivot frame is at substantially 60 degrees angle with respect to the vertical axis of the base. However, in alternate embodiments, one or more means may be provided so that the pivot frame may be at rest in more than two positions. When the pivot frame is in the open position, one or more applicators may be removed from the corresponding cosmetic containers to apply the cosmetic product from the cosmetic containers, or one or more cosmetic containers may be removed and replaced with one or more new cosmetic containers.

According to further aspect of the second embodiment, after the pivot frame is moved to the open position, the user can quickly remove or put on the caps with a single hand without the need of turning the caps. More particularly, the collar and/or the applicators are threadless, like in the first embodiment. The cap bodies of the plurality of applicators of the second embodiment are configured to be releasably locked to the respective neck portions of the respective cosmetic containers by using the same locking mechanism as in the first embodiment.

Thus, the cosmetic package according to second embodiment too includes a two-step lock to secure the plurality of applicators with the neck portions of the base. In the first step, the plurality of caps of the respective plurality of applicators are secured to the respective conical portions of the respective neck portions of the cosmetic containers by the respective elastic members. In the second step, the pivot frame is brought into its first resting position where the pivot frame covers the plurality of caps at least from a top side without abutting the plurality of caps such that the minuscule gap is present between the plurality of caps and the pivot frame which prevents the plurality of applicators from being popped out from the respective reservoirs in the base.

The caps of the cosmetic containers of the present disclosure can be opened by operating on release buttons to provide access to reservoirs of the cosmetic containers and cosmetic products held therein. The cosmetic containers are thus easily opened by pushing the release buttons. Persons for whom a large diameter threaded lid and container might present a challenge are able to use the present cosmetic containers without difficulty. The pivot frame further prevents inadvertent release of the release buttons by securing the caps of the cosmetic containers in the closed position even if the release buttons are not holding the respective caps in the closed position.

According to various example aspects of the present disclosure, the pivot frame and the collar may be constructed from a metal, ceramic, glass, and/or a plastic material including but not limited to, acrylic, polyvinyl chloride and polyethylene, polypropylene, polycarbonate, acrylonitrile butadiene styrene, styrene-acrylonitrile, polymers of cyclohexanedimethanol terephthalic acid (PCTA), polyoxymethylene, nylon, rubber, synthetic rubber, silicone, neoprene, santoprene, thermoplastic rubber, thermoplastic elastomer and combinations thereof. The material may be opaque or clear.

According to alternate embodiments of the present disclosure, instead of the pivot frame, a removable cover may be provided to cover at least a top side of the base.

According to an aspect of the present disclosure, the base may include plurality of receiving openings both on the front face and the back face of the back wall so as to receive a plurality of cosmetic containers on both the front face and the back face of the back wall of the base.

In yet alternate embodiments, the cap of the applicator and the neck portion of a cosmetic container may be removably engaged with each other through threads, snap-fitment or by any other means known in the art.

The above summary provides a basic understanding of the aspects of the disclosure. This summary is not an extensive overview of all contemplated aspects, and is not intended to identify all key or critical elements or to delineate the scope of any or all aspects. Its sole purpose is to present one or more aspects of the disclosure in a summary form as a prelude to the more detailed description that follows and the features described and particularly pointed out in the claims.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
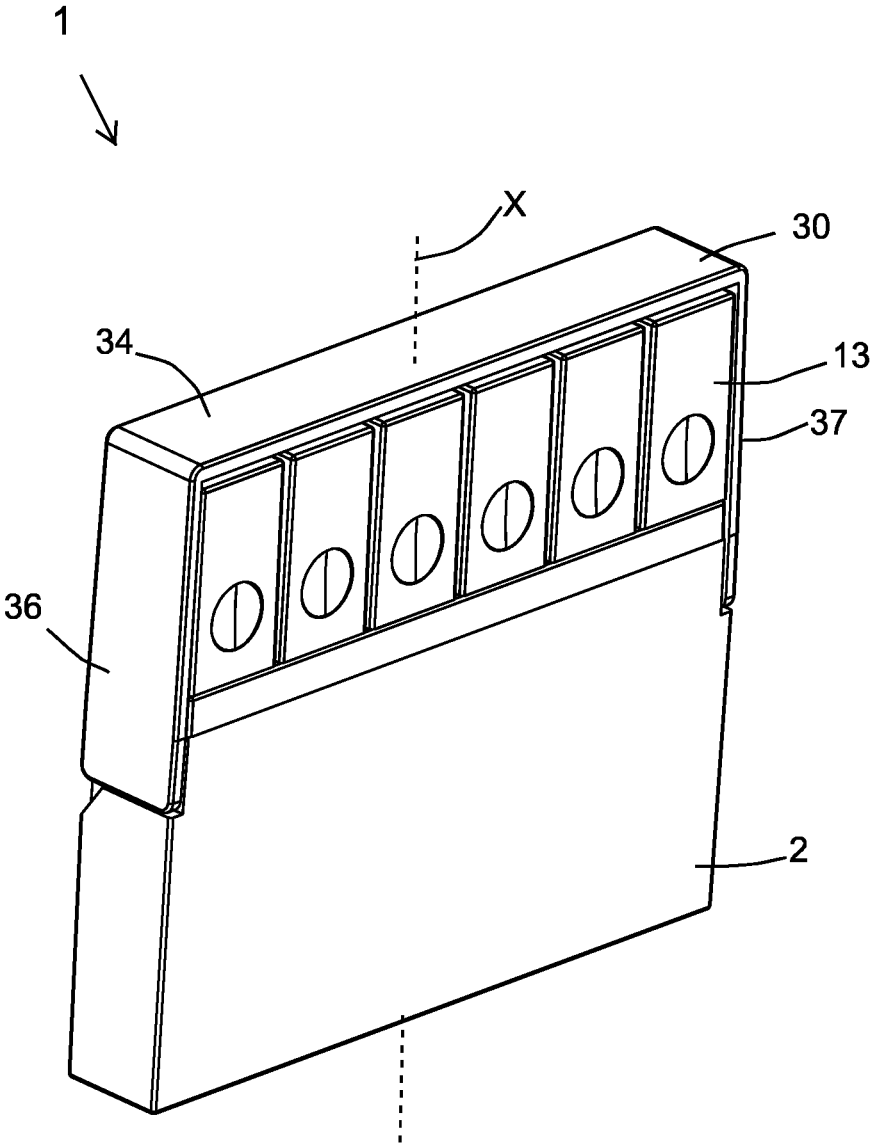
FIG. 1 shows a perspective view of a cosmetic package in a closed state according to an embodiment of the present disclosure.

As shown throughout the drawings, like reference numerals designate like or corresponding parts.

Throughout this specification, the terms "comprise," "comprises," "comprising" and the like, shall consistently mean that a collection of objects is not limited to those objects specifically recited.

FIGS. 1-7 show a cosmetic package 1 according to a first embodiment of the present disclosure.

Figure 7:
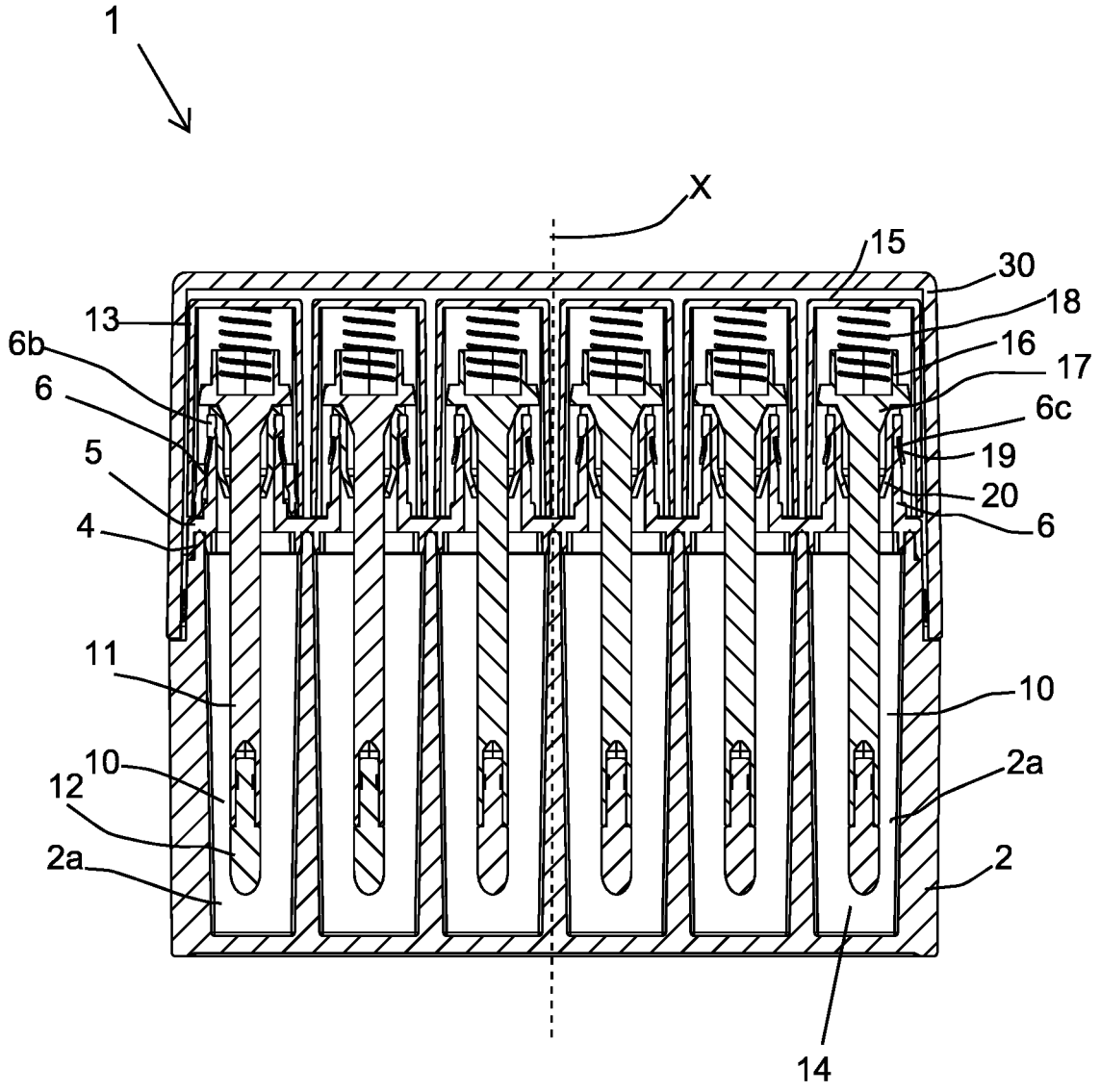
FIG. 7 shows a longitudinal cross section of the cosmetic package of FIG. 3.

As shown in FIG. 7, the cosmetic package 1 comprises a base 2 having a plurality of reservoirs 2*a*, and wherein each of the plurality of reservoirs 2*a* accommodates a cosmetic or a care product therein. The plurality of reservoirs 2*a* is configured to hold a plurality of applicators 10 such that each of the plurality of the reservoirs 2*a* hold a respective applicator of the plurality of the applicators 10. At least two cosmetic products housed in the respective plurality of reservoirs 2*a* may be different from each other and/or at least two applicators 10 of the plurality of applicators 10 housed in the respective plurality of reservoirs 2*a* may be different from each other. The cosmetic product may be including, but not limited to lipstick, lip gloss, mascara, concealer, facial cream and nail polish etc. The cosmetic package 1 thus can selectively hold a variety of cosmetic products having different components or colors, or various applicators having different materials or forms.

According to an aspect of the first embodiment of the present disclosure, base 2 includes the plurality of reservoirs 2*a* that are integrally formed and unitary with the base 2. In alternate embodiments the plurality of reservoirs 2*a* may not be integrally formed and may not be unitary with the base 2.

Figure 6:
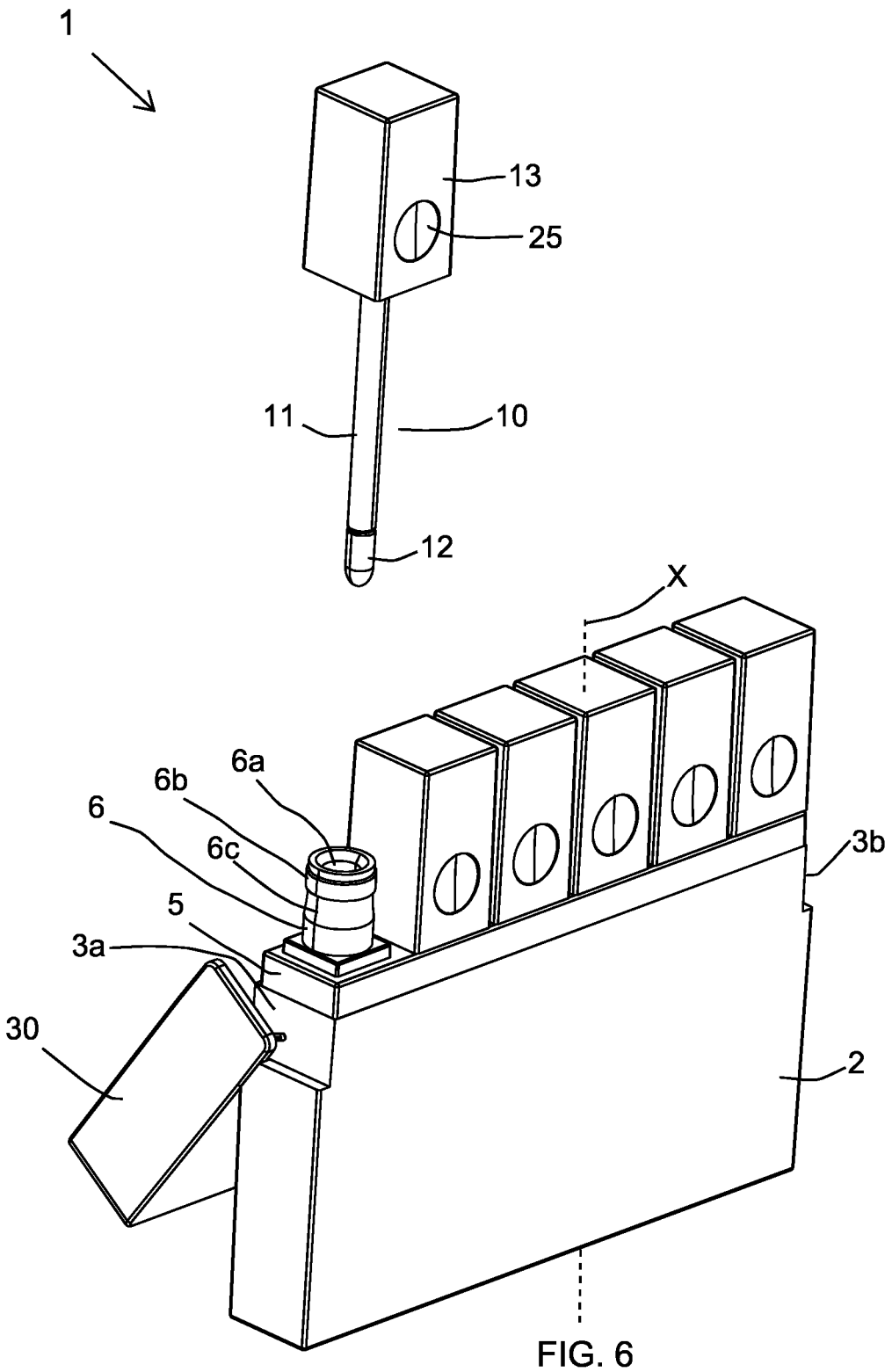
FIG. 6 shows a perspective view of the cosmetic package of FIG. 1 in an open state.
Figure 8:
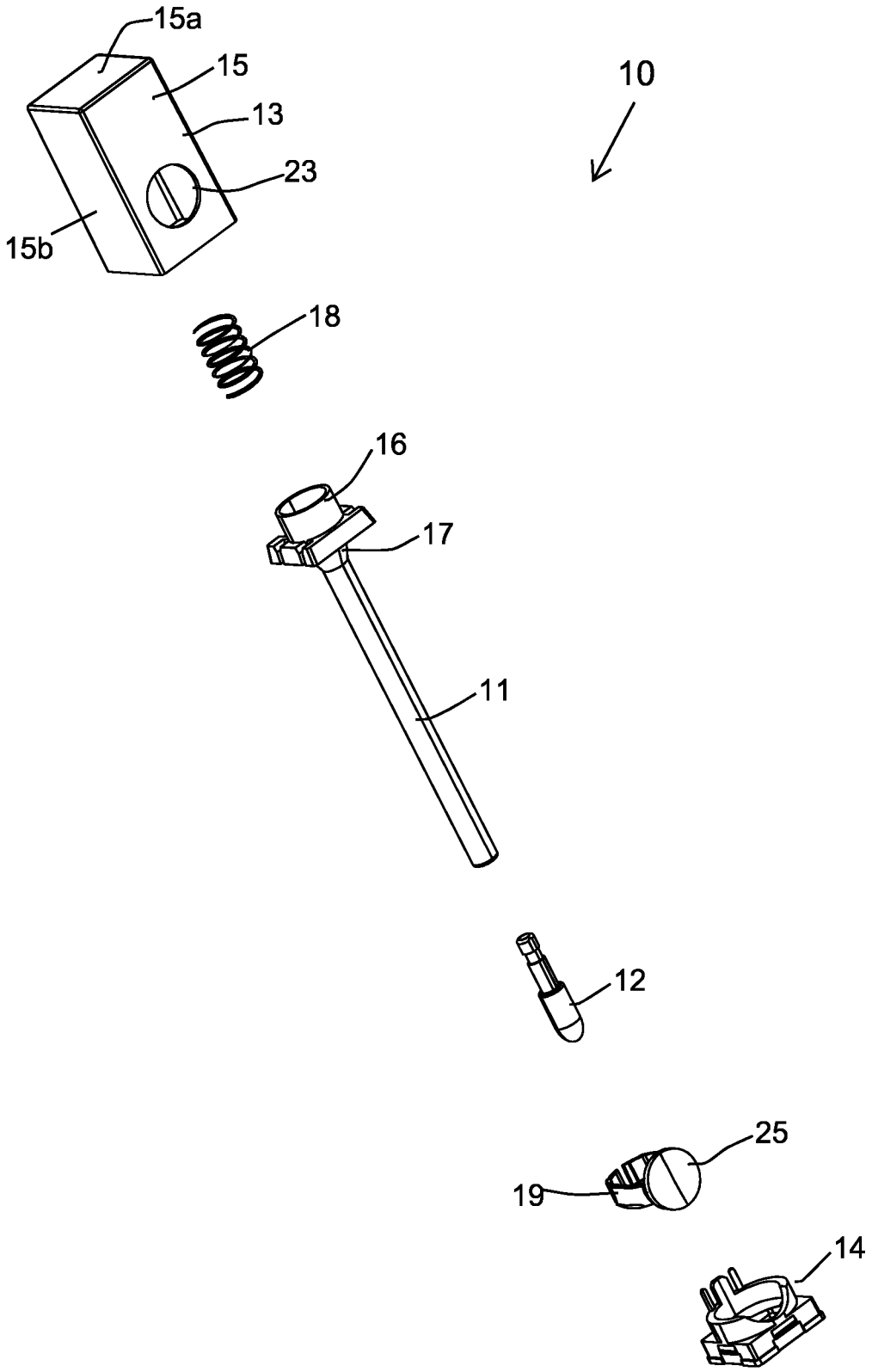
FIG. 8 is an exploded view of an applicator of the cosmetic package of FIG. 6.

As shown in FIGS. 6-8, each of the plurality of applicators 10 has a rod 11, an applicator tip 12 attached to a distal end of the rod 11, and a cap 13 at a proximal end of the rod 11. When each of the plurality of applicators 10 is positioned in the corresponding reservoirs 2*a*, each of the plurality of the caps 13 seals the corresponding reservoirs 2*a* and the corresponding applicator tips 12 from the external environment.

In the embodiment shown, each of the plurality of reservoirs 2*a* are identical to one another and are regularly spaced from one another while extending parallel to one another. In alternate embodiments, however, the plurality of reservoirs 2*a* may not be identical to one another in terms of shape or size and may not be regularly spaced from one another.

The plurality of reservoirs 2*a* comprises a respective plurality of neck portions 6. In various embodiments, the plurality of neck portions 6 may or may not be integral with the plurality of reservoirs 2. In the present embodiment, as shown in FIGS. 6-7, the plurality of neck portions 6 are made up by a collar 5 that is fitted over the proximal end of the base 2. The collar 5 defines the plurality of neck portions 6, each having an orifice 6*a*, and wherein each of the plurality of neck portions 6 corresponds to one of the plurality of reservoirs of the base 2 such that the plurality of neck portions 6 fits over openings 4 (FIG. 7) of the plurality of reservoirs 2*a*. The orifices 6*a* of the neck portions 6 of collar 5 are in communication with the corresponding openings 4 of the base 2.

Further, the plurality of applicators 10 are secured to the base 2 via the collar 5. The orifices 6*a* of the collar 5 are shaped to receive the respective applicators 10 which can be used to apply the cosmetic product from the reservoirs 2*a* to an external surface such as skin or hair. According to certain example aspects of the disclosure, a wiper 20 may be inserted into at least one of the orifices 6*a* of the collar 5 such that the wiper 20 can remove excess cosmetic product from the applicator tip 12 of the associated applicator 10.

According to an aspect of the present disclosure, each reservoir 2*a* along with its respective neck portion 6 and respective applicator 10 constitutes a cosmetic container 14.

In a preferred embodiment, the collar 5 is sonic welded with the base 2 so as to be substantially integral with the base 2. In alternate embodiments, however, the base 2 and collar 5 can be separately formed and attached to one another via an adhesive, snap fit, or any other suitable coupling means known in the art. The base 2 may be constructed from metal, plastic, ceramic, glass, or any combination thereof or a suitable material known in the art. The base 2 in a preferred embodiment is made from a material that imparts transparency so that the cosmetic products stored in the reservoirs 2*a* may be visible to a user.

As described above, in manufacturing of the cosmetic package 1, the connection between the base 2 and the collar 5 can be formed integral by applying a processing method such as double injection, ultrasonic bonding, printing or any other suitable method known in art. It is possible that the base 2 and the collar 5 may have different materials, colors, and transparencies. In a preferred embodiment, when the base 2 is made of a material having transparency, the collar 5 may be formed on an opaque material or vice versa. However, in alternate embodiments, the base 2 and the collar 5 may be made of a material that imparts opaqueness.

Figure 2:
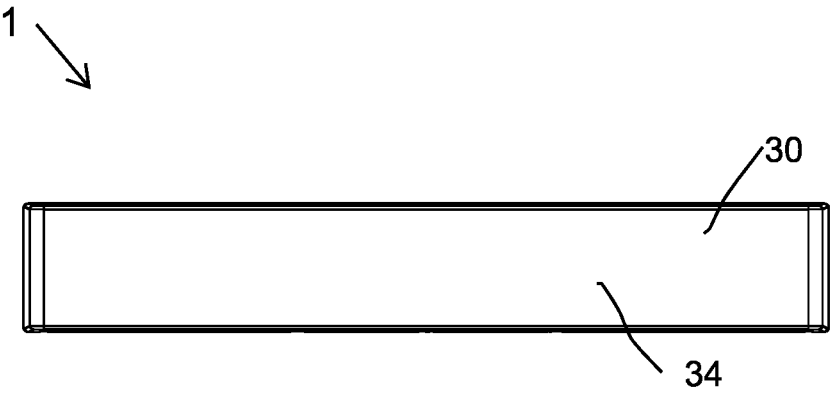
FIG. 2 shows a top view of the cosmetic package of FIG. 1.
Figure 3:
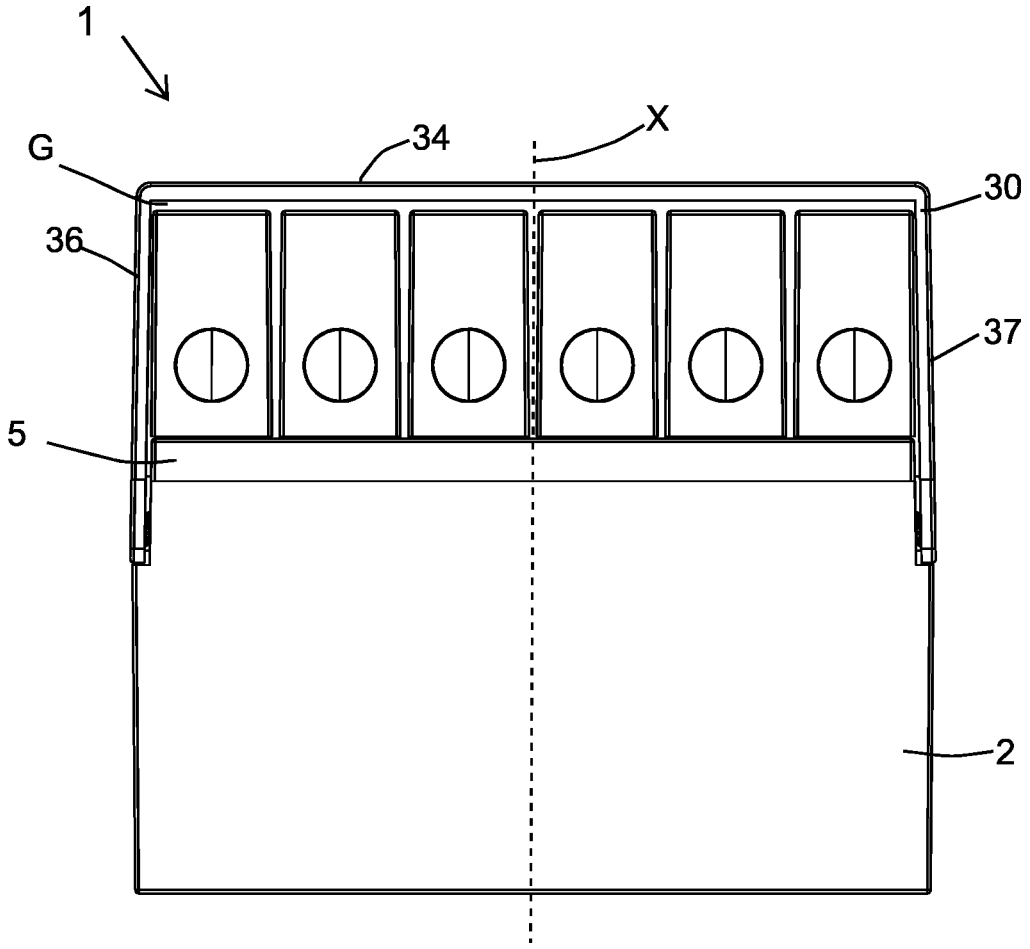
FIG. 3 shows a front view of the cosmetic package of FIG. 1.
Figure 4:
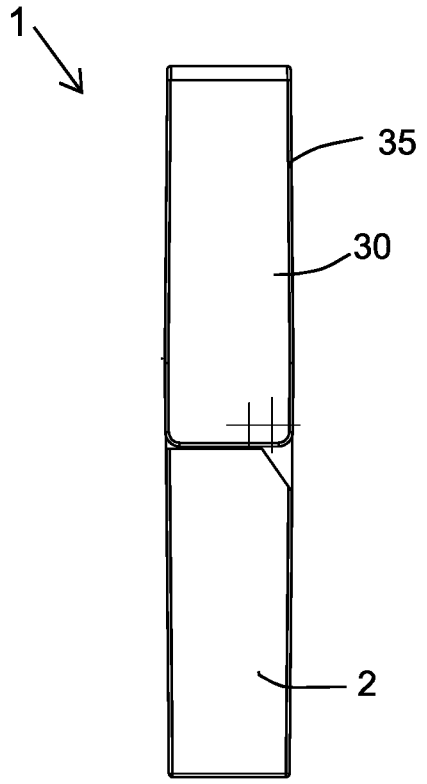
FIG. 4 shows a side view of the cosmetic package of FIG. 1.
Figure 5:
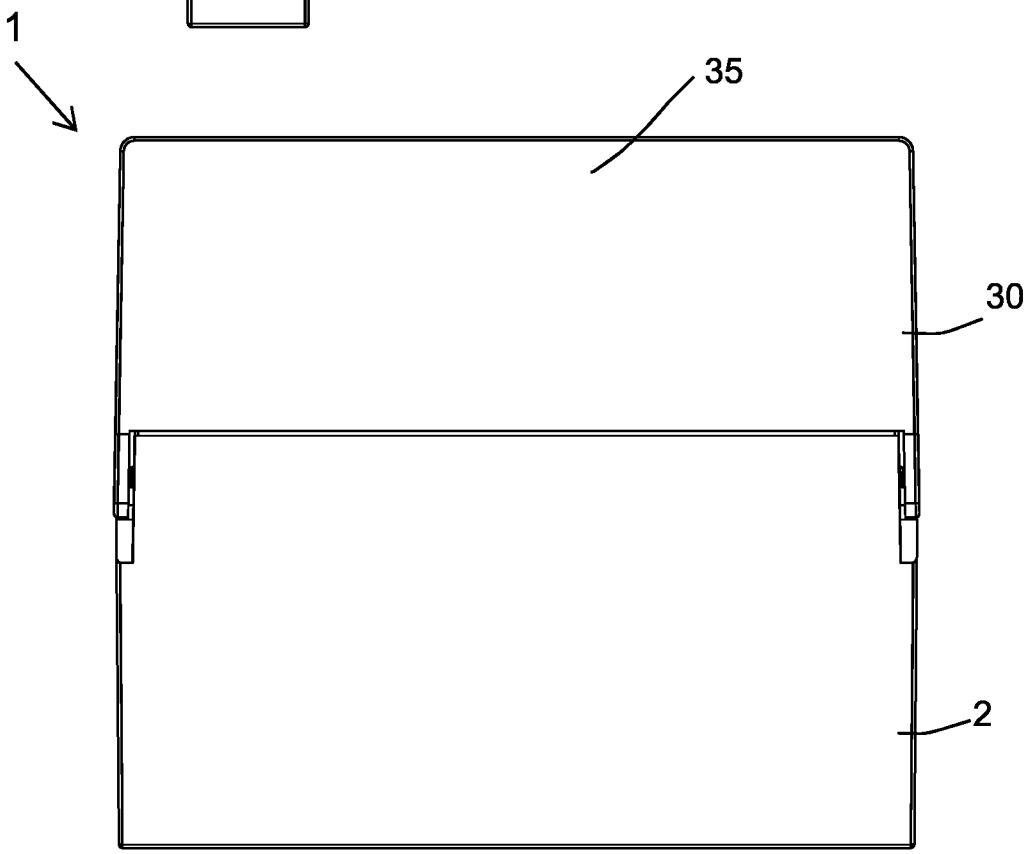
FIG. 5 shows a back view of the cosmetic package of FIG. 1.

The cosmetic package 1 further includes the pivot frame 30 as shown in FIGS. 1-7 and 10. The pivot frame 30 is rotatably attached to the base 2. According to example aspects of the disclosure, the pivot frame 30 may rotate over a range of about at least 60 degrees or greater as shown in FIG. 6. For example, when the pivot frame 30 is in an open position, the pivot frame 30 rotates more than 90 degrees but less than 180 degrees with respect to a vertical axis X of the base 2 as shown in FIG. 6. When the pivot frame 30 is in a closed position, the pivot frame 30 may be parallel or in-line with the vertical axis X of the base 2 as shown in FIGS. 1 and 3. In certain example aspects, when the pivot frame 30 is in the closed position, the pivot frame 30 covers the proximal end of the base 2 so as to house the plurality of caps 13 of the plurality of applicators 10 within a cavity 33 (shown in FIG. 10) of the pivot frame 30.

Figure 9:
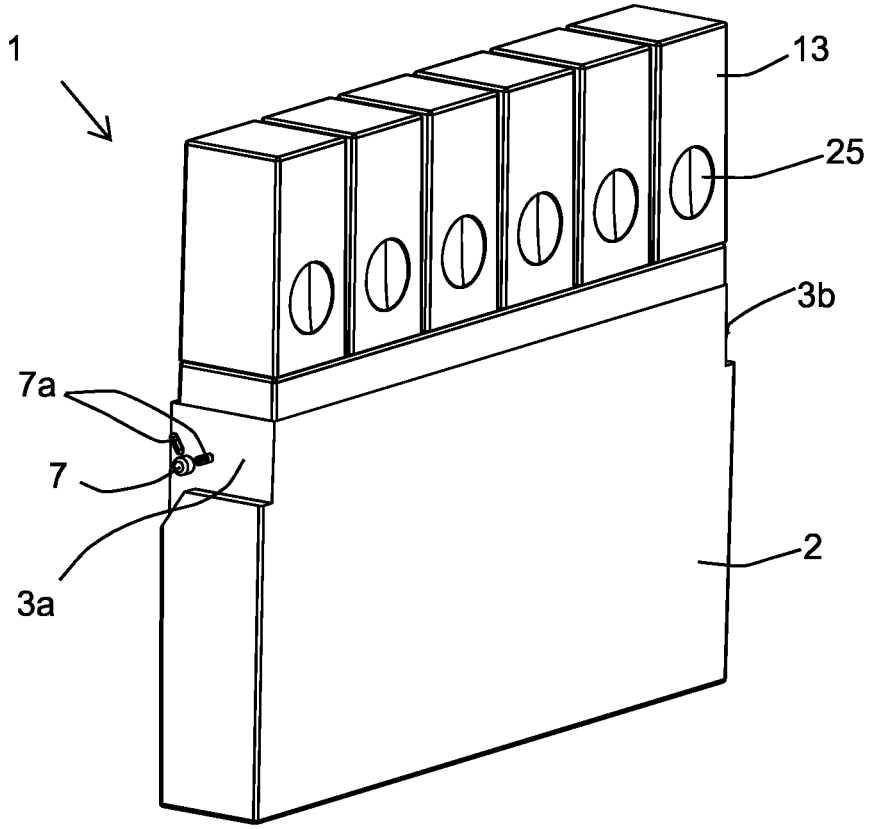
FIG. 9 is a perspective view of the cosmetic package of FIG. 1, shown without a pivot frame of the cosmetic package.
Figure 10:
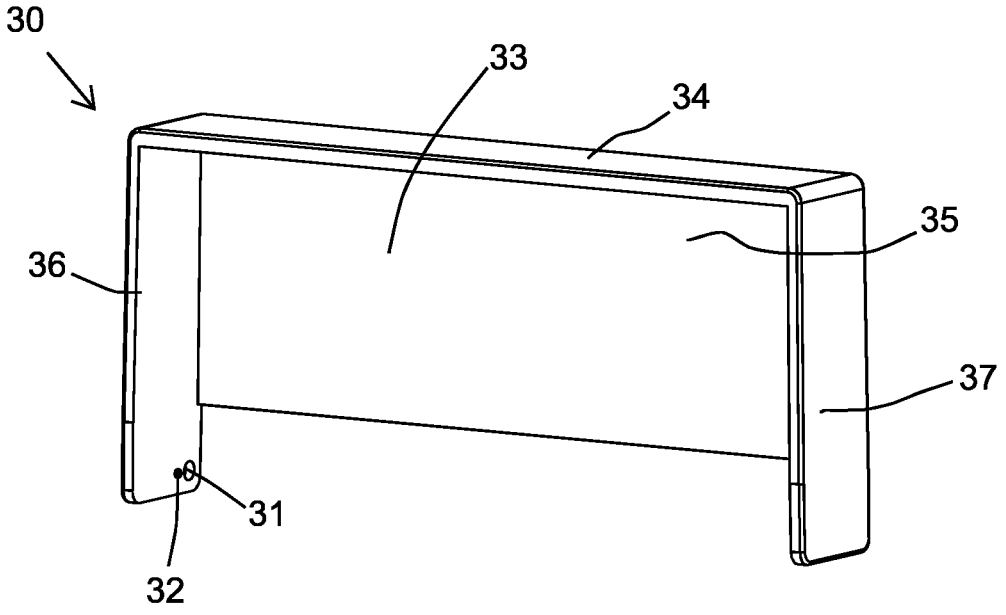
FIG. 10 is a perspective view of the pivot frame of the cosmetic package of FIG. 1.

Referring to FIG. 10, the pivot frame 30 includes a vertically extending back wall 35, a top wall 34, a left sidewall 36 and a right sidewall 37, and wherein the top wall 34, the left sidewall 36 and the right sidewall 37 each extends orthogonally from the front surface of the back wall 35. The pivot frame 30 is rotatably attached to the base 2 through a pair of recesses 31 and a pair of protrusions 7 such that the pair of recesses 31 in the pivot frame 30 can mate with the pair of protrusions 7 on the opposite sides of the base 2, refer FIGS. 9 and 10. More particularly, inner surfaces of the left sidewall 36 and the right sidewall 37 include the pair of recesses 31 that mate with the corresponding pair of protrusions 7 on a left side and a right side of the base 2. More particularly, the pair of protrusions 7 are present on an upper left edge 3*a* and an upper right edge 3*b* of the base 2. Alternatively, the recesses 31 may be positioned the base 2 and the protrusions 7 on the pivot frame 30 (not shown). Other methods and apparatus known to those of ordinary skill in the art for rotatably attaching the pivot frame 5 to the base 2 e.g., hinges like mechanical or living hinges are also possible and may be used; the examples disclosed herein are not limiting.

Referring to FIGS. 1-5, in the closed position, the pivot frame 30 provides protection to a top side of the base 2 by covering the base 2 from the top side. In certain example aspects, the pivot frame 30 protects/covers substantially an entire of the upper left edge 3*a*, the upper right edge 3*b* and the top side of the base 2 (see FIG. 6). More particularly, in the closed position, the pivot frame 30 covers or encloses the plurality of caps 13 of the plurality of applicators 10 together from four sides of the cosmetic package 1, namely from a top side, a back side, a left side and a right side of the cosmetic package 1 by the corresponding top wall 34, the back wall 35, the left sidewall 36 and the right sidewall 37 of the pivot frame 30. In the closed position, the plurality of caps 13 of the plurality of applicators 10 is visible only from a front side of the cosmetic package 1 as the cosmetic package is not covered by the pivot frame 30 from the front. The top wall 34 of the pivot frame 30 extends over the plurality of caps 13 of the plurality of applicators 10 without abutting them i.e. a gap exists between the top wall 35 of the pivot frame 30 and the plurality of caps 13 of the plurality of applicators 10 which is sufficiently small enough so that the pivot frame 30 is able to prevent the plurality of applicators 10 from dislodging from the cosmetic package 1 by restricting axial movement of the plurality of applicators 10, upon accidental actuation in the closed position of the cosmetic package 1.

Further as shown in FIGS. 9 and 10, the cosmetic package 1 includes a means that allows the pivot frame 30 to rest at two different angular positions with respect to the base 2.

The means includes a pair of projections 7*a* on both the upper left edge 3*a* and the upper right edge 3*b* of the base 2, and a pair of bumps 32 on inner surfaces of the left sidewall 36 and the right sidewall 37 of the pivot frame 30. The pair of projections 7*a* on each of the upper left edge 3*a* and the upper right edge 3*b* of the base 2, are spaced radially. A first resting position of the pivot frame 30 with respect to the base 2 corresponds to the closed position of the pivot frame 30 where the pivot frame 30 is at a substantially zero angle with the vertical axis X of the base 2, see FIG. 1. When the pivot frame 30 is rotated in order to open the cosmetic package 1, the pair of bumps 32 of the pivot frame 30 overrides one of the respective pair of projections 7*a* of the base 2 and the pivot frame 30 thus pivots about the vertical axis X till it overrides the other of the respective pair of projections 7*a* of the base 2 to be locked in a second resting position in which the pivot frame 30 is at a non-zero angle with respect to the vertical axis X of the base 2, see FIG. 6. In the embodiment shown in FIG. 6, the pivot frame 30 is at substantially 145 degrees angle with respect to the vertical axis X of the base 2. However, in alternate embodiments, one or more means may be provided so that the pivot frame 30 may be at rest in more than two positions.

When the pivot frame 30 is in the open position as shown in FIG. 6, one or more applicators 10 may be removed from the corresponding reservoirs 2*a* to apply the cosmetic product from the reservoirs 2*a*.

According to an aspect of the present disclosure, after pivot frame 30 is moved to the open position, the user can quickly remove or put on the caps 13 with a single hand without the need of turning the caps 13. More particularly, the base 2, the collar 5, and/or the applicators 10 are threadless.

According to an aspect of the present disclosure, as shown in FIG. 7-8, each of the plurality of caps 13 comprises a cap body 15 adapted to be detachably fitted around the respective neck portion 6 of the collar 5. The cap body 15 comprises a top wall 15*a* and at least one sidewall 15*b* extending downwardly from the top wall 15*a*. The cap body 15 receives the proximal end of the rod 11 in inner side of the cap body 15. The proximal end of the rod 11 includes a spring support seat 16 which at its bottom end carries a plug 17 having a substantially truncated inverted conical outer surface and adapted to be seated conformingly on an upper edge of the respective neck portion 6 of the collar 5. A spring 18 is mounted in the spring support seat 16 such that it extends between the top wall 15*a* of the cap body 15 and the spring support seat 16 in a compressed state to bias the plug 17 downwardly. The spring support seat 16 is in sliding contact with the inner wall of the cap body 15. A stopper 14 is provided at a distal end of the cap body 15 which is coupled to an inner surface of the cap body 15 at the distal end of the cap body 15 and with the rod 11, in order to prevent the plug 17 from getting out of the cap body 15.

As shown in FIGS. 6, 7 and 8, the cap 13 further includes an elastic member 19 mounted to the inner surface of the cap body 15 near its distal end. When the cap body 15 is pushed onto the neck portion 6 of the collar, the elastic member 19 which is substantially annular can pass over a cylindrical rim portion 6*b* of the respective neck portion 6 and after passing the cylindrical rim portion 6*b*, it engages a conical portion 6*c* of the neck portion 6 which is stepped in from the cylindrical rim portion 6*b*, thereby preventing the cap body 15 from being pulled out of the respective neck portion 6 of the collar 5. The cap 13 further includes a release button 25 as a disengaging means attached with the elastic member 19 provided near the distal end of the cap body 15. By pushing in the release button 25, the elastic member 19 disengages from the neck portion 6 of the collar 5. However, in various embodiments, the release button 25 and the elastic member 19 may or may not be integrally attached.

In a rested state, the elastic member 19 has a substantially oval or fusiform cross-section (not shown) with its major axis substantially larger than a diameter of the cylindrical rim portion 6*b* of the neck portion 6 of the collar 5 and its minor axis is smaller than the diameter of the cylindrical rim portion 6*b*. When elastically deformed to a substantially circular shape, the inner diameter of the elastic member 19 will be larger than the diameter of the cylindrical rim portion 6*b* of the neck portion 6 of the collar 5.

The elastic member 19 and the release button 25 may be made of a resilient metal or a hard and elastic synthetic resin. The release button 25 is slidably received in a radial through hole 23 formed in the at least one sidewall 15*b* of the cap 13.

In an unstressed or rested state shown in FIG. 7, the elastic member 19 engages the conical portion of the neck portion, keeping the cap 13 from coming off the base 2. When the release button 25 is pushed in by pressing, the elastic member is compressed from both ends of its major axis and deformed into a substantially circular shape having a larger diameter than the diameter of the cylindrical rim portion 6*b* of the neck portion 6 (not shown). In this state, the elastic member 19 disengages from the conical portion 6*c* of the neck portion 6. The cap 13 is thus spontaneously pushed up by the force of the spring 18, thus popping out of the applicator 10 in vertical direction provides a visual indicator to a user that the applicator 10 is now unlocked from the base 2. Thus, the cap 13 can be removed from the neck portion 6 of the base 2 simply by pushing in the release button 25 with one finger. When the finger is released from the release button 25, the elastic member 19 will return to its original oval shape by its own resiliency.

In the open position, the pivot frame 30 may act as a stand which supports the base 2 in a slanting upright position.

According to various example aspects of the disclosure, as shown in FIG. 2A, the cosmetic package 1 includes a base 2 with six reservoirs 2*a* and respective six applicators 10. In other alternate embodiments, the number of reservoirs and/or applicators may be more or less than six.

Figure 11:
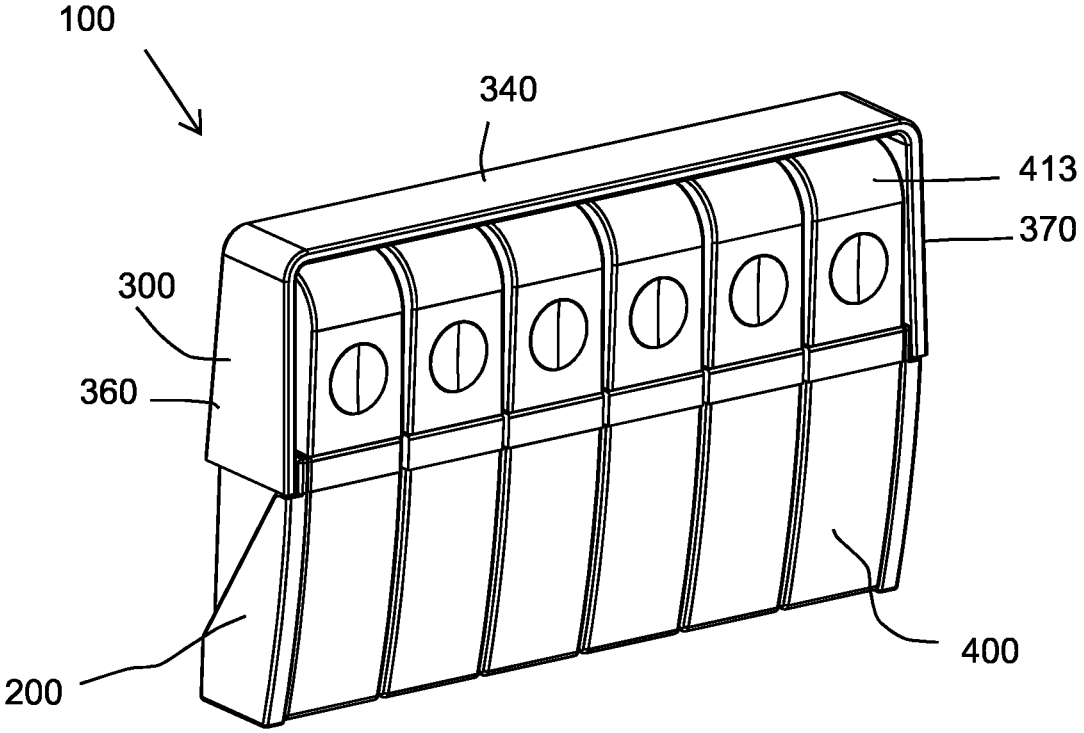
FIG. 11 shows a perspective view of a cosmetic package in a closed state according to a second embodiment of the present disclosure.

FIGS. 11-18 show a cosmetic package 100 according to a second embodiment of the present disclosure. As shown in FIG. 11, the cosmetic package 100 comprises a base 200, a pivot frame 300 and at least one cosmetic container 400. The at least one cosmetic container 400 and the base 200 being removably secured to one another. The pivot frame 300 is rotatably attached to the base 200. More particularly, the pivot frame 300 and a plurality of cosmetic containers 400 removably secured to the base 200. Each of the plurality of cosmetic containers 400 accommodates a cosmetic or a care product therein and may or may not be configured to hold a corresponding applicator 410 (see FIG. 13). At least two cosmetic products housed in the respective plurality of cosmetic containers 400 may or may not be different from each other and/or at least two applicators 410 housed in the respective plurality of cosmetic containers 400 may or may not be different from each other. The cosmetic package 100 thus can selectively hold a variety of cosmetic products having different components or colors, or various applicators having different materials or forms.

In an embodiment, the plurality of cosmetic containers 400 contains various shades of a single type of cosmetic product. Alternatively, in an embodiment, the plurality of cosmetic containers 400 contain different types of cosmetic products. As will be clear to one of skill in the art, various combinations of cosmetics may be selected based on the particular needs of the users. In an embodiment, each of the plurality of the cosmetic containers 400 are substantially square in cross sectional profile. As will be clear to one of skill in the art, the cosmetic containers 400 may have any other profile.

Figure 13:
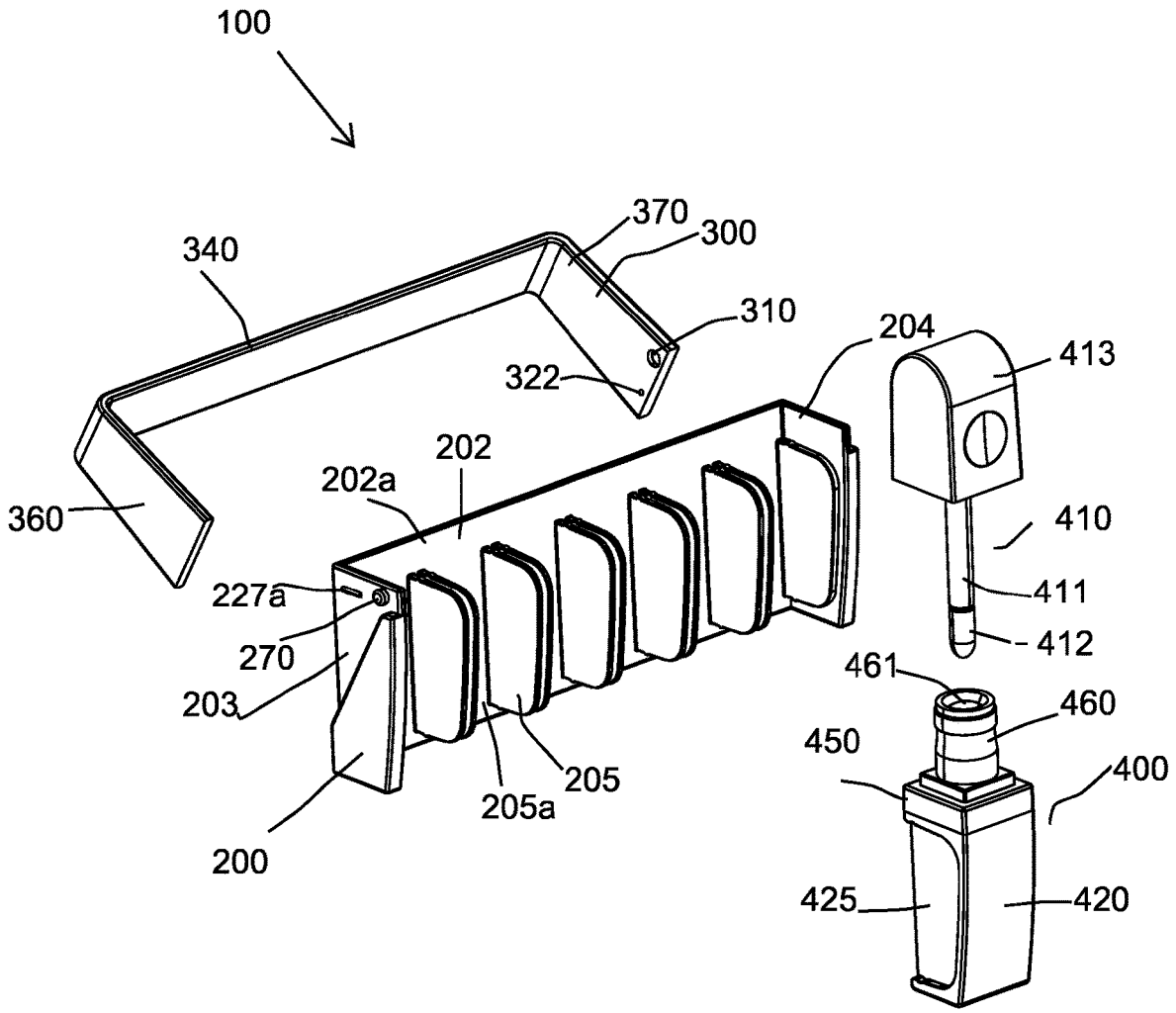
FIG. 13 shows an exploded view of an applicator of the cosmetic package of FIG. 11.
Figure 19:
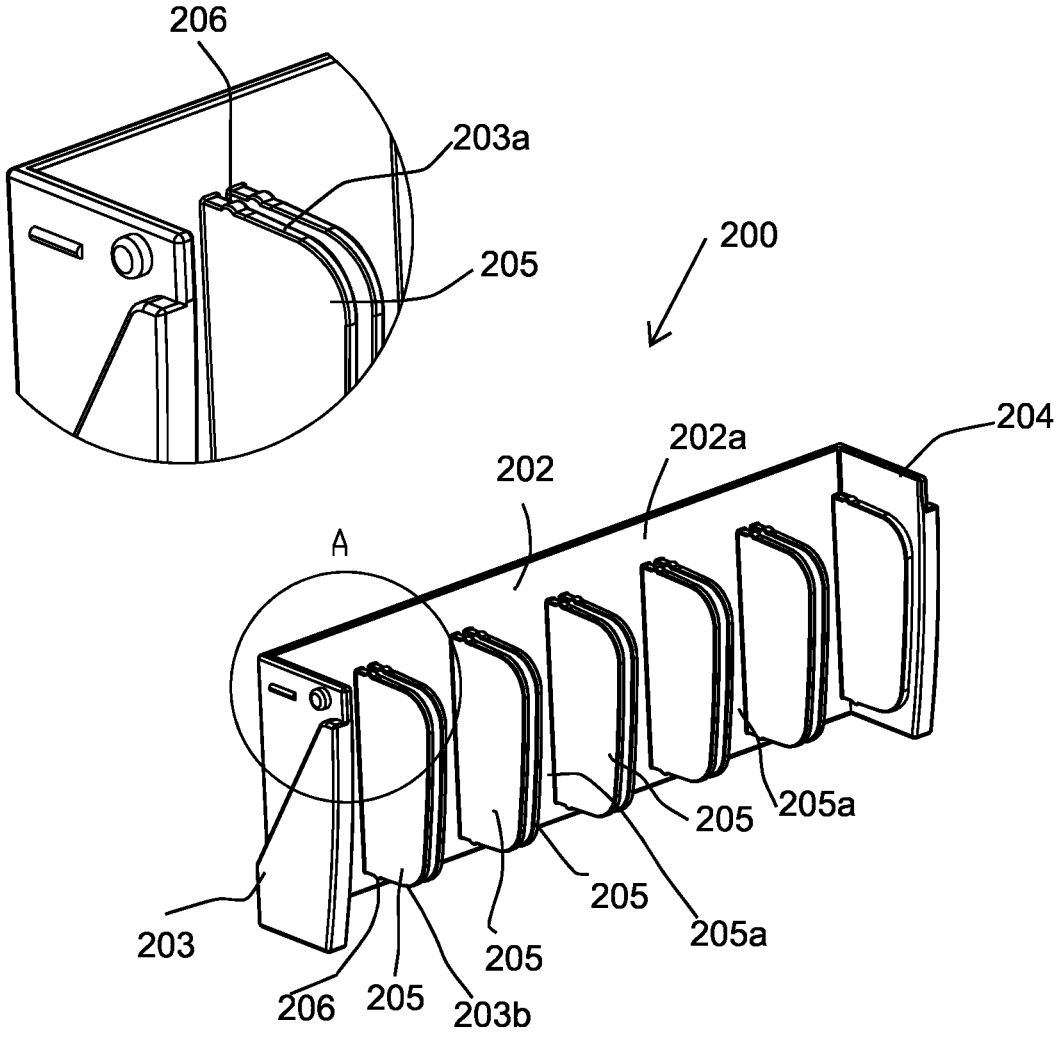
FIG. 19 is a perspective view of a base of the cosmetic package of FIG. 11; and shows an enlarged view of a portion of the base to show details.
Figure 20:
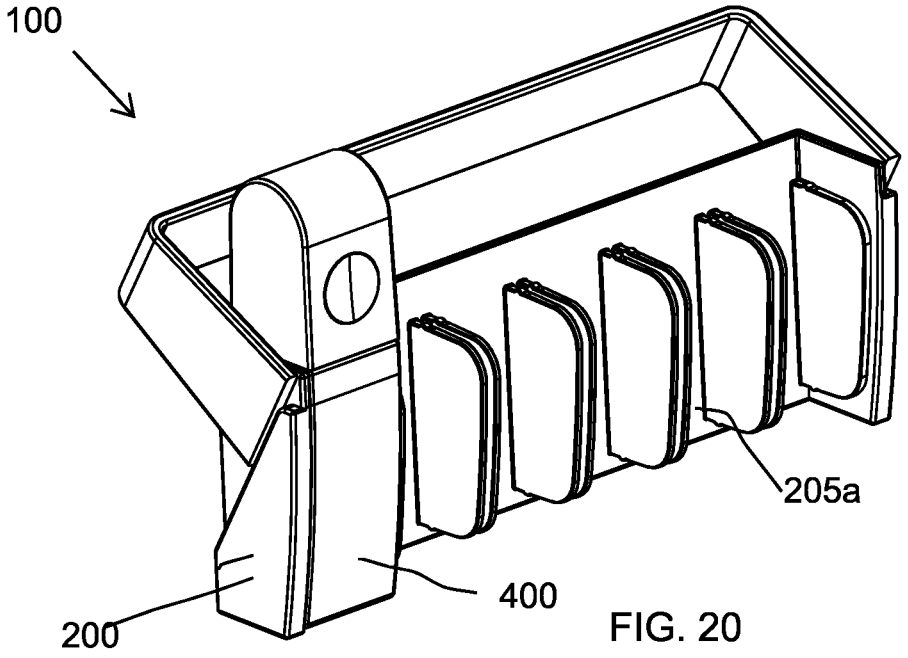
FIG. 20 is a perspective view of the cosmetic package of FIG. 11, showing only one cosmetic container secured to the base of the cosmetic package.

Referring to the FIGS. 13 and 19 show a perspective view of the base 200. The base 200 includes a vertically extending back wall 202. A left sidewall 203 and a right sidewall 204 extending substantially perpendicularly from a front surface 202*a* of the back wall 202 of the base 200. The base 200 comprises a plurality of receiving openings 205*a* for receiving the plurality of cosmetic containers 400, see FIGS. 19 and 20. The front face 202*a* of the back wall 202 further includes a plurality of partition walls 205 extending substantially perpendicularly therefrom. The plurality of partition walls 205 are arranged and spaced in a manner so as to define the receiving openings 205*a* for holding the plurality of cosmetic containers in the base 200. In other words, each of the plurality of receiving openings 205*a* is a space defined by two adjacent partition walls 205 separated by the front surface 202*a* of the back wall 202 of the base 200.

Further, as shown in FIG. 19, each receiving opening 205*a* dimensioned to receive a cosmetic container 400 and has a width corresponding to a width of the corresponding cosmetic container 400. Further, the width of each of the plurality of receiving openings 205*a* is substantially equivalent. Thus, a user may rearrange the plurality of cosmetic containers 400 (which are all substantially equal in size) as desired. In an alternative embodiment, different sizes of the cosmetic containers 400 may be used, for example by having different spacings between the various partition walls 205 forming the different sizes of the plurality of receiving openings 205*a* in the base 200.

Figure 17:
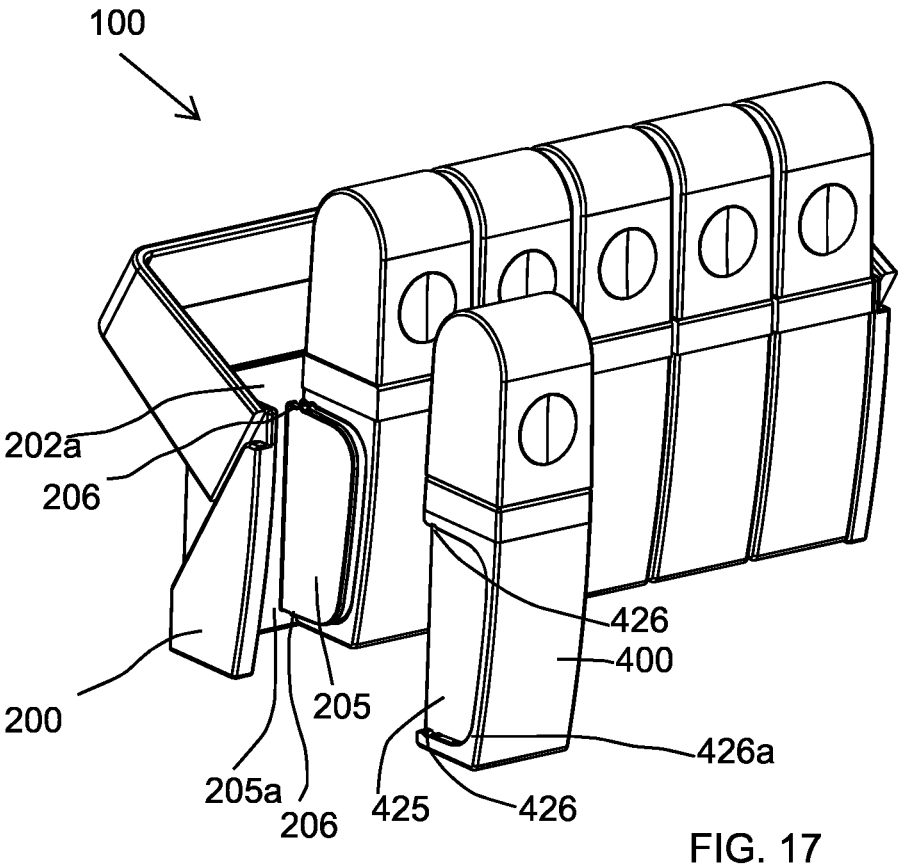
FIG. 17 is a perspective view of the cosmetic package of FIG. 11 showing a cosmetic container in a detached state from a base of the cosmetic package.

The base 200 detachably engages the plurality of cosmetic containers 400 on the front surface 202*a* of its back wall 202. Specifically, FIGS. 17 and 19 show the base 200 is adapted for securing six cosmetic containers 400 at the front face 202*a* of its back wall 202 and includes twelve partition walls 205 extending from the front face 202*a* of the back wall 202. It is to be understood that the present disclosure is not limited to the embodiments depicted and can be modified to accommodate any number of cosmetic containers 400 and any number of the partition walls 205.

Figure 14:
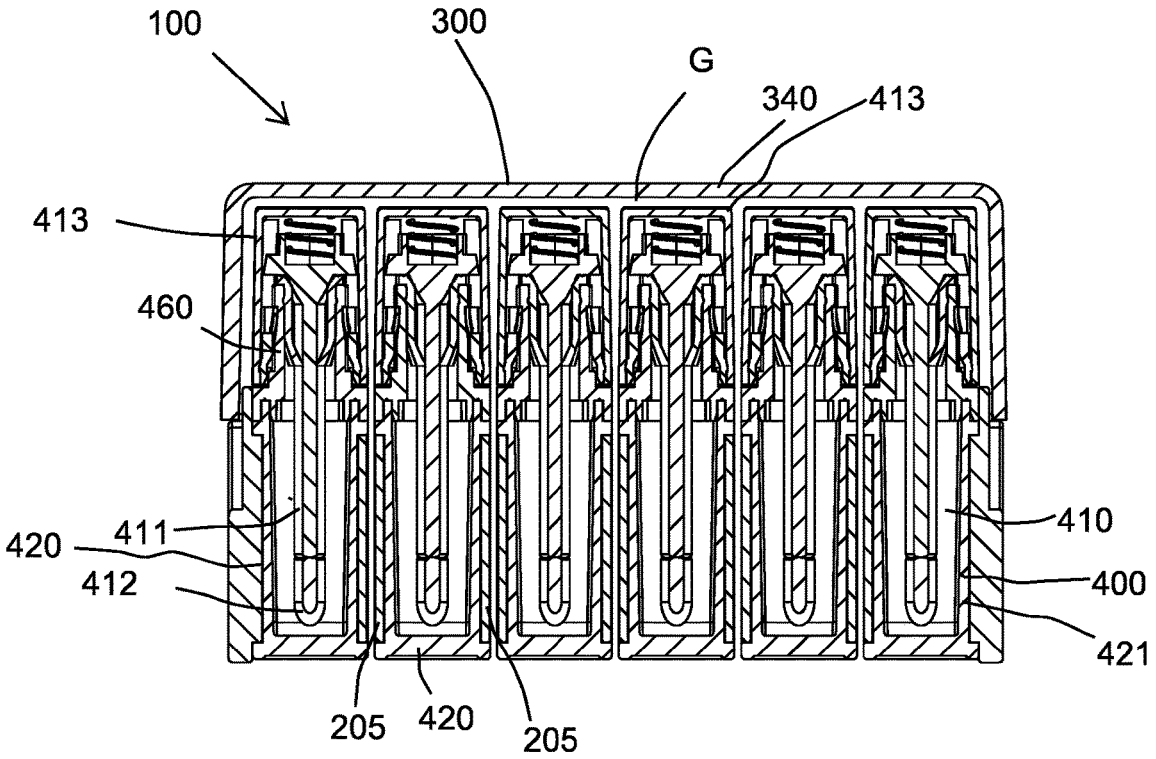
FIG. 14 shows a longitudinal cross section of the cosmetic package of FIG. 12.

As shown in FIGS. 13-14, each of the plurality of cosmetic containers 400 includes a reservoir 420 and a corresponding applicator 410 associated with said reservoir 420. Each of the applicators 410 comprises a rod 411, an applicator tip 412 attached to a distal end of the rod 411, and a cap 413 attached to a proximal end of the rod 411. When each of the plurality of applicators 410 is positioned in the corresponding reservoir 420, each of the plurality of the caps 413 seals the corresponding reservoir 420 and the corresponding applicator tips 412 from an external environment. The cap 413 retains the rod 411 for dipping the applicator tip 412, which is fixed to the distal end of the rod 411, into a volume of the cosmetic product retained within the reservoir 420. The applicator tip 412 of the cosmetic container 400 can, for example, comprise a flocked member, a brush, or any other structure capable of retrieving the cosmetic product from the inner volume of the reservoir 420 and applying the cosmetic product to a body surface of a user, such as the user's lips, eyebrows, or eyelashes. The cosmetic container 400 can be sealed during periods of nonuse by an engagement between the cap 413 and a neck portion 460 of the reservoir 420.

Figure 21:
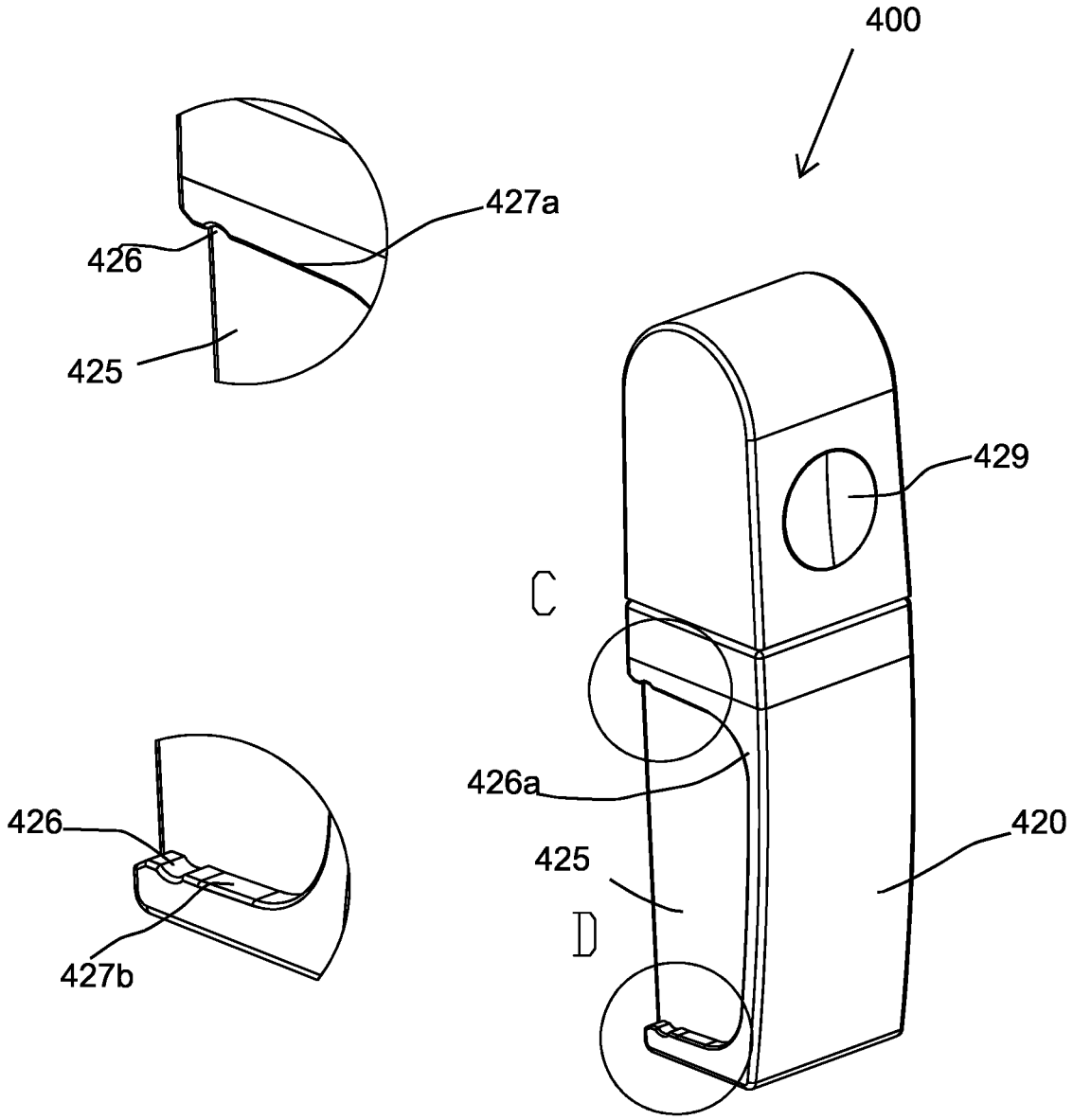
FIG. 21 is a perspective view of the cosmetic container of the cosmetic package of FIG. 11 showing enlarged views of portions of the cosmetic container to show details thereof.
Figure 22:
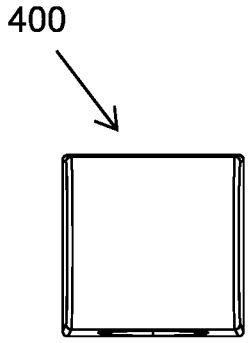
FIG. 22 shows a top view of the cosmetic container of FIG. 21.
Figure 23:
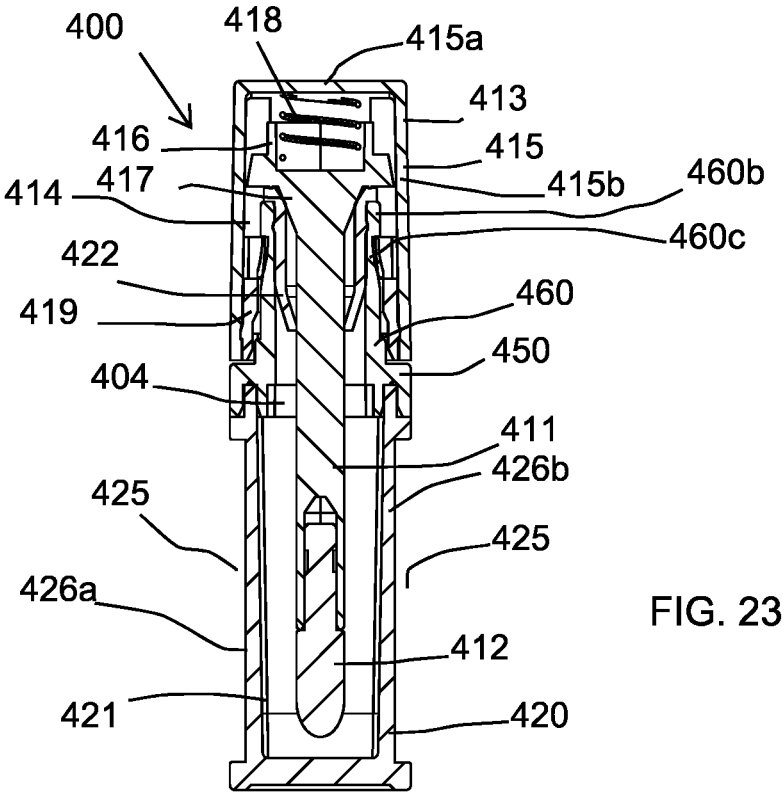
FIG. 23 shows a cross sectional view of the cosmetic container of FIG. 21.

As shown in FIGS. 21 and 23, each of the reservoir 420 of the cosmetic containers 400 include a least two opposing recesses 425 on two opposing sidewalls 426*a*, 426*b* of the reservoir 420. Each of the opposing recesses 425 is sized so as to accommodate the corresponding partition wall 205. In other words, the at least two opposing recesses 425 on the two opposing sidewalls 426*a*, 426*b* of the reservoir 420 are dimensioned to receive the two adjacent partition walls 205 of the base 200 when the cosmetic container 420 is inserted into the receiving opening 205*a* provided in the base 200.

The cosmetic containers 400 are preferably releasably secured to the base 200, more particularly to the partition walls 205, to allow removal of the cosmetic containers 400 from the base 200, when desired.

Figure 15:
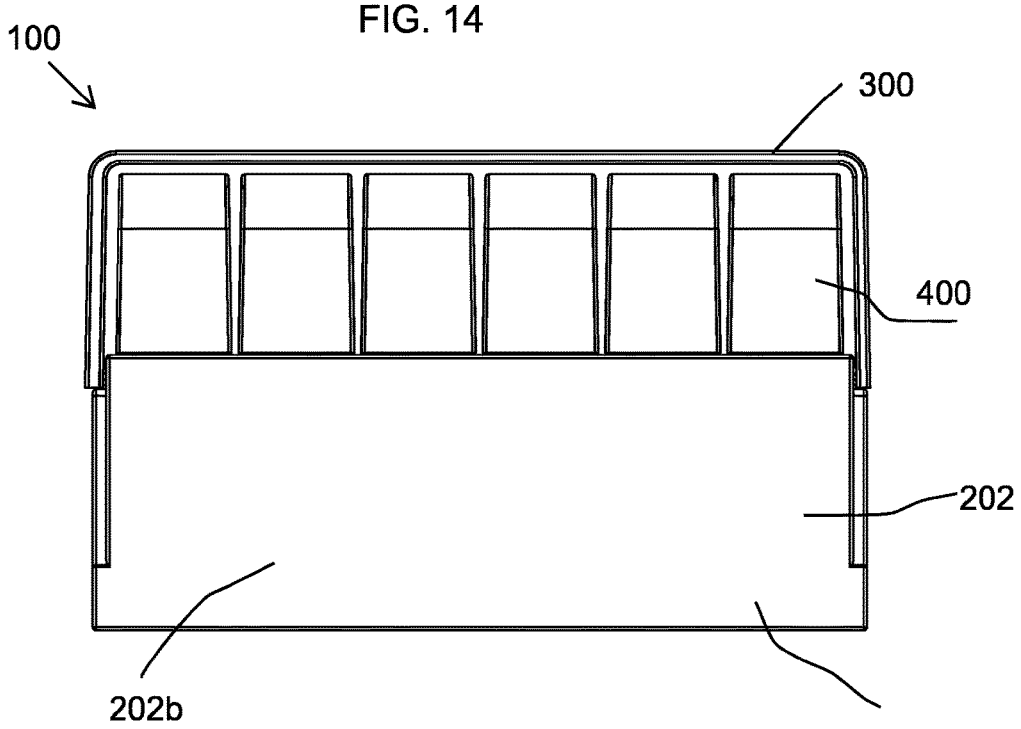
FIG. 15 shows a back view of the cosmetic package of FIG. 12.

As shown in FIGS. 14, 15 and 17, the dimensions of the plurality of the receiving openings 205*a* are preferably substantially the same as the reservoirs 420 of the plurality of cosmetic containers 400 to allow the plurality of cosmetic containers 400 to be snap fit or press fit into the corresponding plurality of receiving openings 205*a*. The plurality of cosmetic containers 400 and the base 200 are made of a compliant material to facilitate the snap fit of the plurality of cosmetic containers 400 into the corresponding plurality of receiving openings 205*a* of the base 200.

As seen in FIG. 19, to ensure that the plurality of cosmetic containers 400 is securely retained in the corresponding plurality of receiving openings 205*a*, each of the partition walls 205 are preferably provided with a snap protrusion 206 both on an upper edge 203*a* and a lower edge 203*b* of the partition wall 205 and each of the reservoir 420 of the plurality of cosmetic containers 400 is provided with a corresponding snap groove 426 in each of the two opposing recesses 425 at an upper edge 427*a* and a lower edge 427*b* thereof (as shown in FIG. 11). The snap grooves 426 on the reservoir 420 of the cosmetic containers 400 is configured to mate with snap protrusions 206 on the partition walls 205 of the base 200 for establishing a readily attachable and detachable snap-connection between the plurality of cosmetic containers 400 and the base 200, when the plurality of cosmetic containers 400 are snap fit into the corresponding plurality of receiving openings 205*a* provided in the base 200.

As shown in FIG. 17, to install a cosmetic container 400 in the base 200, the cosmetic container 400 is aligned with the respective receiving opening 205*a* and then pushed into the receiving opening 205*a* such that the partition walls 205 associated with said receiving opening 205*a* are received in the opposing recesses 425 on the two opposing sidewalls 426*a*, 426*b* of the reservoir 420 of the cosmetic container 400 and the cosmetic container 400 snap fit into the receiving opening 205*a* because of the mating of snap protrusions 206 of the partition walls 205 with the snap grooves 426 provided on the reservoir 420 of the cosmetic container 400. In the embodiment shown, the partition walls 205 substantially flush with the two opposing sidewalls 426*a*, 426*b* of the reservoir 420 of the cosmetic container 400 when the cosmetic container 400 is located in the base 200.

To release or remove a single desired cosmetic container 400, a user holds the individual cosmetic container 400 and applies pulling pressure to the cosmetic container 400 towards the front direction so that the snap protrusions 206 of the partition walls 205 disengage from the snap grooves 426 of the cosmetic container 400.

The present disclosure is not intended to be limited to snap protrusions and snap grooves described herein. Rather, other known detachable means may be used that detachably engage the plurality of cosmetic containers 400 from the base 200.

The removable cosmetic containers 400 enable a user to change the order of the color of the cosmetic containers 400 on the base 200. Moreover, an individual cosmetic container 400 may be replaced without the need to replace the entire base 200. In a preferred embodiment of the disclosure, the base 200 is reusable and when a cosmetic container 400 is depleted, a new cosmetic container 400 can be provided in the base 200. This enables a user to change out the cosmetic containers 400 held within the cosmetic package 100, for example, to customize the particular variety of cosmetics held within the cosmetic package 100 at a given time.

Further, in an embodiment, the cosmetic package 100 may contain decorative or informational matter over a portion of a back surface 202*b* (refer FIG. 15) on the back wall 202 of the base 200, such as a manufacturer's name or logo or instructions for use of the cosmetics held within the cosmetic containers 400.

Referring to FIG. 13, an individual reservoir 420 comprises a cosmetic storage portion 421 and a collar 450. The cosmetic storage portion 421 has an opening 404 at a proximal portion of the storage portion 421 and the collar 450 is fitted over the opening 404 of the cosmetic storage portion 421, and wherein the collar 450 includes a neck portion 460 having an orifice 461 (see FIG. 13). The neck portion 460 of the collar 450 fits over the opening 404 of the cosmetic storage portion 421 of the reservoir 420. The orifice 461 of the collar 450 is in communication with the corresponding opening 404 of the cosmetic storage portion 421 of the reservoir 420.

According to certain example aspects of the disclosure, as seen in in FIG. 23, a wiper 422 may be inserted into the orifice 461 of the collar 450 such that the wiper 422 can remove excess cosmetic product from the applicator tip 412 of the associated applicator 410. When the applicator tip 412 is dipped in the cosmetic storage portion 421 of the reservoir 420, it becomes loaded with the cosmetic product. The rod 411 and the applicator tip 412 are then withdrawn from the reservoir 420, the wiper 422 removes the excess cosmetic product from the applicator tip 412 and the rod 411.

In a preferred embodiment, the collar 450 is sonic welded with the cosmetic storage portion 421 so as to be substantially integral with the cosmetic storage portion 421 of the reservoir 420. In alternate embodiments, however, the cosmetic storage portion 421 and the collar 450 can be separately formed and attached to one another via an adhesive, snap fit, or any other suitable coupling means known in the art. In yet alternate embodiment, the collar 450 comprising the neck portion 460 may be formed integrally with the cosmetic storage portion 421 by using a single material or more than one material. In manufacturing of the cosmetic package 100, the connection between the cosmetic storage portion 421 and the collar 450 can be formed integral by applying a processing method such as double injection, ultrasonic bonding, printing or any other suitable method known in art. It is possible that the cosmetic storage portion 421 and the collar 450 may have different materials, colors, and transparencies. In a preferred embodiment, when the cosmetic storage portion 421 is made of a material having transparency, the collar 450 may be formed on an opaque material or vice versa. However, in alternate embodiments, the cosmetic storage portion 421 and the collar 450 may be made of a material that imparts opaqueness.

Further, the pivot frame 300 is rotatably attached to the base 200. According to example aspects of the disclosure, the pivot frame 300 may rotate over a range of about 60 degrees or greater as shown in FIG. 6. For example, in the second embodiment, when the pivot frame 300 is in an open position, the pivot frame 300 rotates 60 degrees with respect to a vertical axis X of the base 200 as shown in FIG. 6. When the pivot frame 300 is in a closed position, the pivot frame 300 may be parallel or in-line with the vertical axis X of the base 200 as shown in FIGS. 1 and 2. In certain example aspects, when the pivot frame 300 is in the closed position, the pivot frame 300 covers the proximal end of the base 200 so as to cover the plurality of cosmetic containers 400 from their top.

In the second embodiment, referring to FIG. 13, the pivot frame 300 includes only a top wall 340, a left sidewall 360 and a right sidewall 370. The pivot frame 300 is rotatably attached to the base 200 through a pair of recesses 310 and a pair of protrusions 270 such that the pair of recesses 310 in the pivot frame 300 can mate with the pair of protrusions 270 on the opposite sides of the base 200. More particularly, inner surfaces of the left sidewall 360 and the right sidewall 370 include the pair of recesses 310 that mate with the corresponding pair of protrusions 270 on the outer surfaces of the left sidewall 203 and the right sidewall 204 of the base 200. Alternatively, the pair of recesses 310 may be positioned in the base 200 and the pair of protrusions 270 is positioned in the pivot frame 300 (not shown). Other means known to those of ordinary skill in the art for rotatably attaching the pivot frame 300 to the base 200 e.g., hinges like mechanical or living hinges are also possible and may be used; the examples disclosed herein are not limiting.

Figure 12:
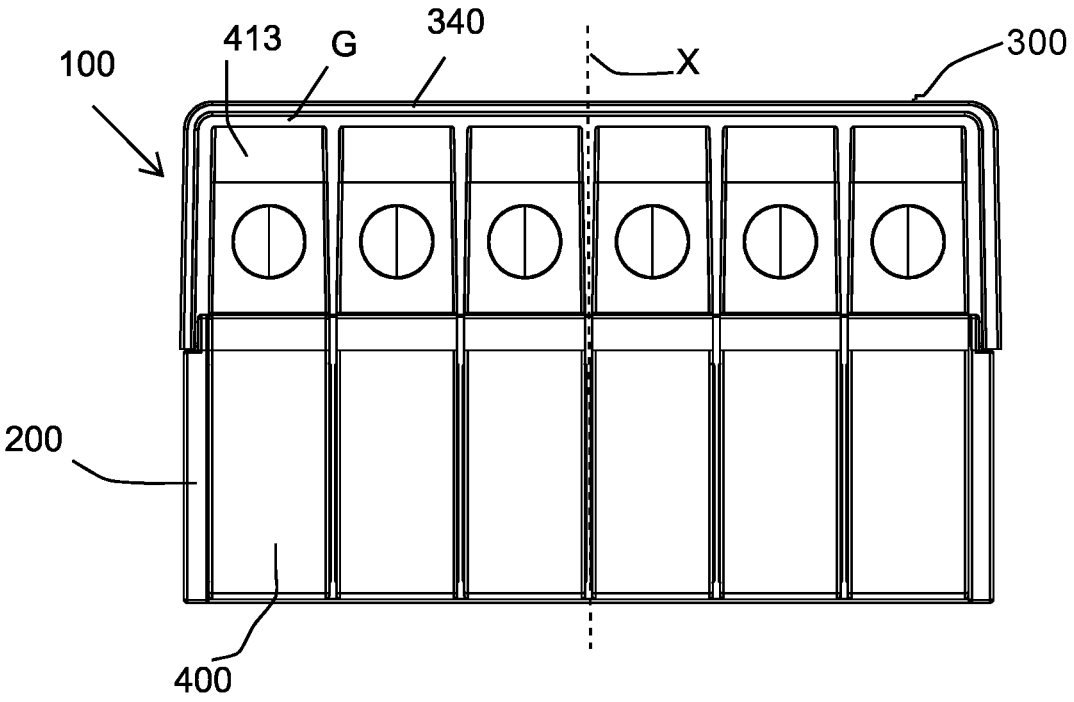
FIG. 12 shows a front view of the cosmetic package of FIG. 11.

Referring to FIGS. 11-12, in the closed position, the pivot frame 300 provides covers a top side of the base 200. In the closed position, the pivot frame 30 encloses a plurality of caps 413 of the plurality of cosmetic containers 400 from a top side, a left side and a right side of the cosmetic package 100 by the corresponding top wall 340, the left sidewall 360 and the right sidewall 370 of the pivot frame 300. In the closed position, the plurality of caps 413 of the plurality of cosmetic containers 400 is visible from a front side and a back side of the cosmetic package 100. As shown in FIGS. 12 and 14, the top wall 340 of the pivot frame 300 extends over the plurality of caps 413 without abutting them i.e. a gap G exists between the inner surface of the top wall 340 of the pivot frame 300 and the outer surfaces of the plurality of caps 413 of the plurality of cosmetic containers 400 which is sufficiently small enough so that the pivot frame 300 is able to prevent the plurality of applicators 410 from dislodging from the cosmetic package 100 by restricting axial movement of the plurality of applicators 410, upon accidental actuation in the closed position of the cosmetic package 100.

Figure 16:
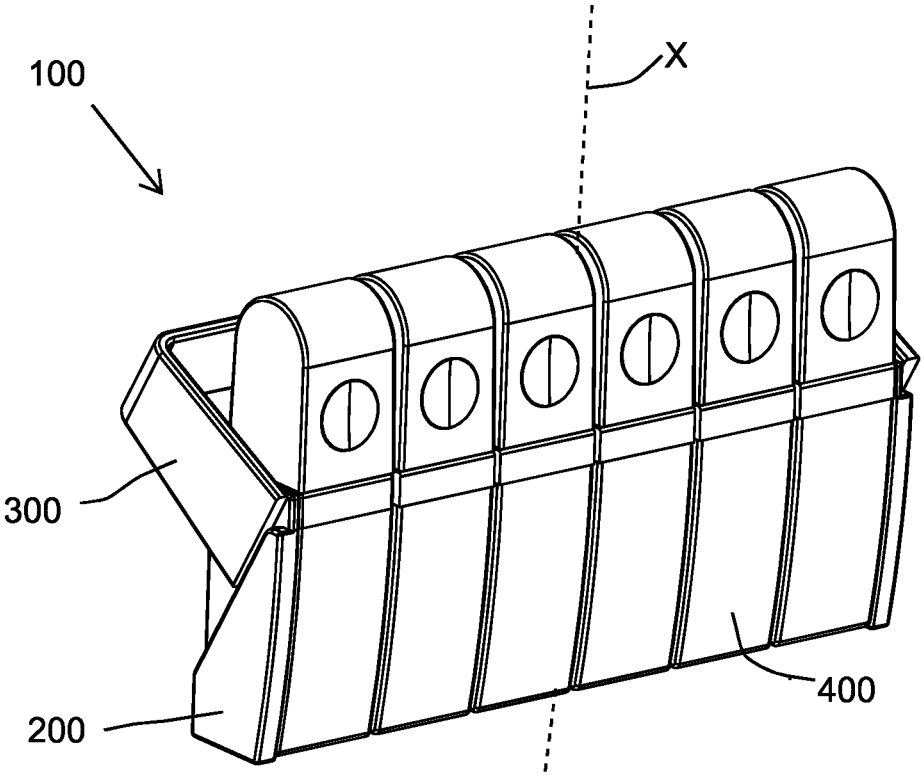
FIG. 16 is a perspective view of the cosmetic package of FIG. 11, showing the cosmetic package in an open state.

The pivot frame 300 is configured to have a closed position and at least one open position. In the open position of the pivot frame 300, as shown in FIG. 16, the plurality of cosmetic containers 400 are accessible for use or can be disengaged from the base 200. In a closed position of the pivot frame 300, as shown in FIG. 12, the pivot frame 300 prevents accidental opening of the plurality of the cosmetic containers 400 from the base.

Figure 18:
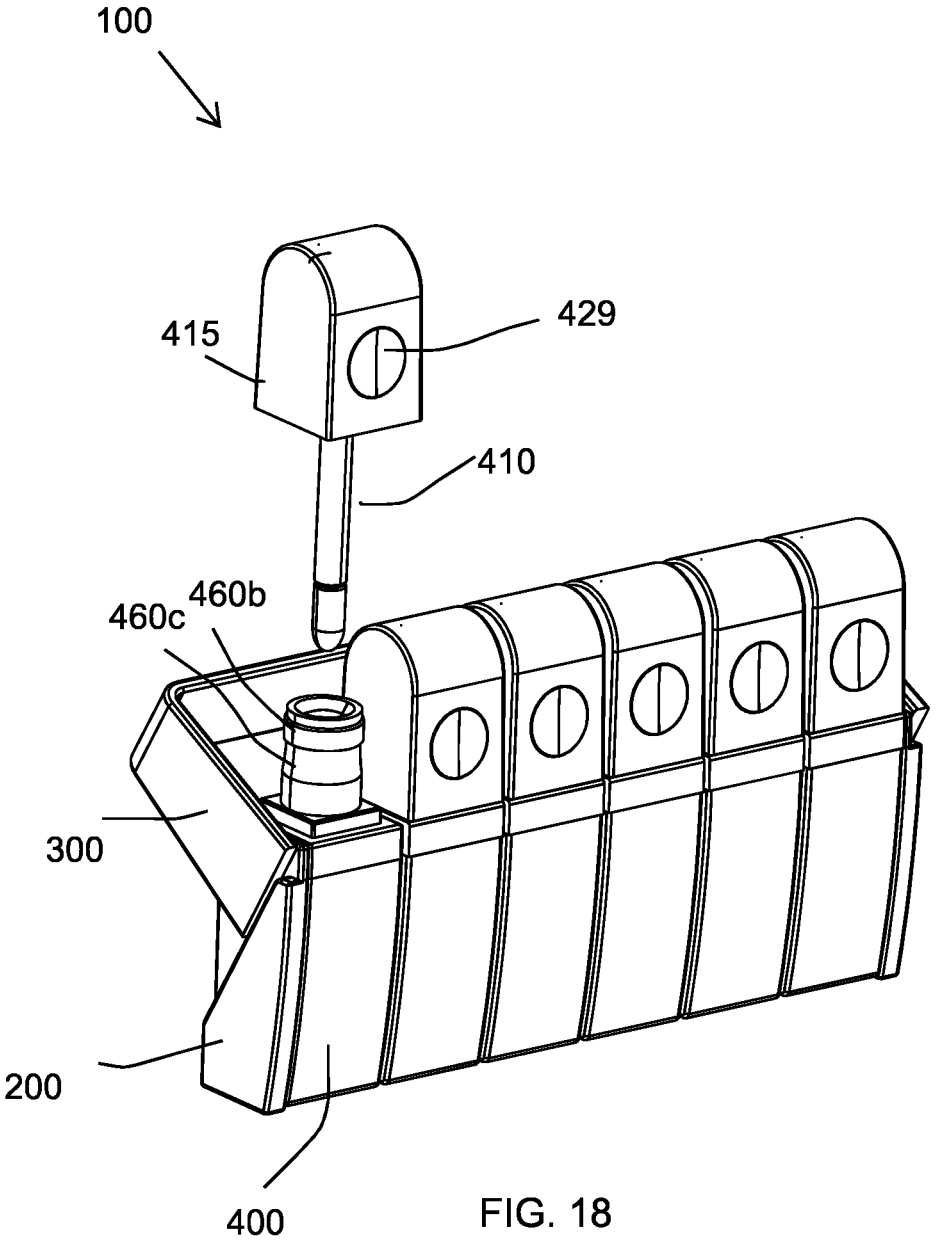
FIG. 18 is a perspective view of the cosmetic package of FIG. 11, showing a cosmetic container in an open state.

Further as shown in FIG. 13, the cosmetic package 100 includes a means that allows the pivot frame 300 to rest at an angular position with respect to the base 200. The means includes projections 227*a* on outer surfaces of both the left sidewall 203 and the right sidewall 204 of the base 200, and a pair of bumps 322 on inner surfaces of the left sidewall 360 and the right sidewall 370 of the pivot frame 300. A first resting position of the pivot frame 300 with respect to the base 200 corresponds to the closed position of the pivot frame 300 where the pivot frame 300 is at a substantially zero angle with the vertical axis X of the base 200, see FIG. 12. When the pivot frame 300 is rotated in order to open the cosmetic package 100, the pair of bumps 322 of the pivot frame 300 overrides the respective pair of projections 227*a* of the base 200 and the pivot frame 300 thus pivots about the vertical axis X and locks in a second resting position in which the pivot frame 300 is at a non-zero angle with respect to the vertical axis X of the base 200, see FIG. 16. In the embodiment shown in FIG. 16, the pivot frame 300 is at substantially 60 degrees angle with respect to the vertical axis X of the base 200. However, in alternate embodiments, one or more means may be provided so that the pivot frame 300 may be at rest in more than two positions. When the pivot frame 300 is in the open position as shown in FIG. 18, one or more applicators 410 may be removed from the corresponding cosmetic containers 400 to apply the cosmetic product from the cosmetic containers 400, or one or more cosmetic containers 400 may be removed and replaced with one or more new cosmetic containers 400 as shown in FIG. 17.

According to further aspect of the present disclosure, after the pivot frame 300 is moved to the open position, the user can quickly remove or put on the caps 413 with a single hand without the need of turning the caps 143. More particularly, the collar 450 and/or the applicators 410 are threadless.

Figure 24:
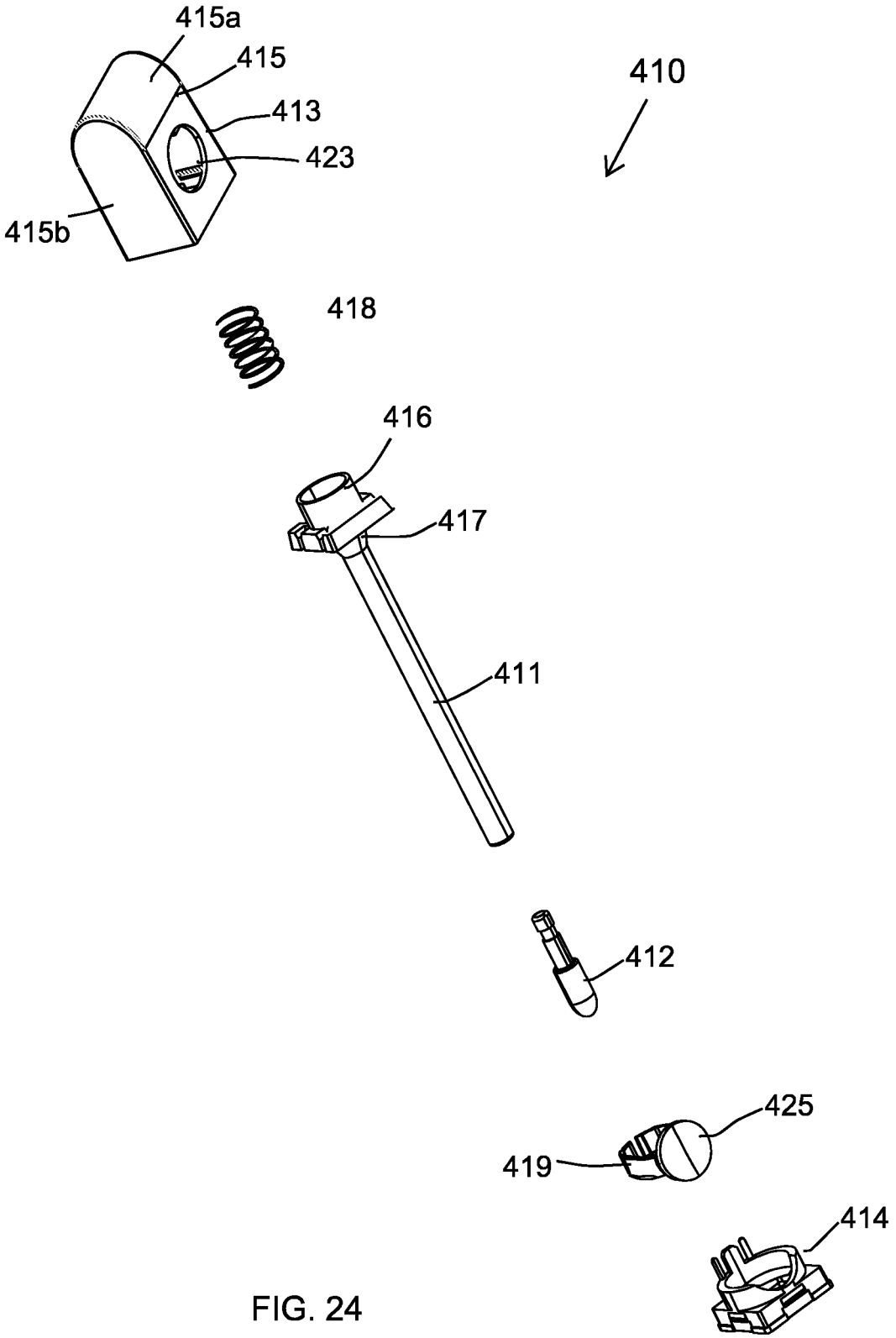
FIG. 24 shows an exploded view of an applicator of the cosmetic container of FIG. 23.

According to an aspect of the present disclosure, as shown in FIGS. 23-24, the cap 413 comprises a cap body 415 adapted to be detachably fitted around the respective neck portion 460 of the collar 450. The cap body 415 comprises a top wall 415*a* and at least one sidewall 415*b* extending downwardly from the top wall 415*a*. The cap body 415 receives the proximal end of the rod 411 on the inner side of the cap body 415. The proximal end of the rod 411 includes a spring support seat 416 which at its bottom end carries a plug 417 having a substantially truncated inverted conical outer surface and adapted to be seated conformingly on an upper edge of the respective neck portion 460 of the collar 450. A spring 418 is mounted in the spring support seat 416 such that it extends between the top wall 415*a* of the cap body 415 and the spring support seat 416 in a compressed state to bias the plug 417 downwardly. The spring support seat 416 is in sliding contact with the inner wall of the cap body 415. A stopper 414 is provided at a distal end of the cap body 415 which is coupled to an inner surface of the cap body 415 at the distal end of the cap body 415 and with the rod 411, in order to prevent the plug 417 from getting out of the cap body 415.

As shown in FIG. 23, the cap 413 further includes an elastic member 419 mounted to the inner surface of the cap body 415 near its distal portion. When the cap body 415 is pushed onto the neck portion 460 of the collar 450, the elastic member 419 is annular and can pass over a cylindrical rim portion 460*b* of the respective neck portion 460 and after passing the cylindrical rim portion 460*b*, it engages a conical portion 460*c* of the neck portion 460 which is stepped in from the cylindrical rim portion 460*b*, thereby preventing the cap body 415 from being pulled out of the respective neck portion 460 of the collar 450. The cap 413 further includes a release button 429 as a disengaging means attached with the elastic member 419 provided near the distal end of the cap body 415. By pushing in the release button 429, the elastic member 419 disengages from the neck portion 460 of the collar 450. However, in alternate embodiments, the release button 429 and the elastic member 419 may or may not be integrally attached.

In a rested state, the elastic member 419 has a substantially oval or fusiform cross-section (not shown) with its major axis substantially larger than a diameter of the cylindrical rim portion 460*b* of the neck portion 460 of the collar 450 and its minor axis is smaller than the diameter of the cylindrical rim portion 460*b*. When elastically deformed to a substantially circular shape, the inner diameter of the elastic member 419 will be larger than the diameter of the cylindrical rim portion 460*b* of the neck portion 460 of the collar 450.

The elastic member 419 and the release button 429 may be made of a resilient metal or a hard and elastic synthetic resin. The release button 429 is slidably received in a radial through hole 423 (see FIG. 24) formed in the at least one sidewall 415*b* of the cap 413.

In an unstressed state shown in FIG. 23, the elastic member 419 engages the conical portion 460*c* of the neck portion 460 of the collar 450, keeping the cap 413 from coming off the base 200. When the release button 429 is pushed in by pressing, the elastic member 419 is compressed from both ends of its major axis and deformed into a substantially circular shape having a larger diameter than the diameter of the cylindrical rim portion 460*b* of the neck portion 460 (not shown). In this state, the elastic member 419 disengages from the conical portion 460*c* of the neck portion 460. The cap 413 is thus spontaneously pushed up by the force of the spring 418, thus popping out of the applicator 410 in a vertical direction provides a visual indicator to a user that the applicator 410 is now unlocked from the base 200. Thus, the cap 413 can be removed from the neck portion 460 of the base 200 simply by pushing in the release button 429 with one finger. When the finger is released from the release button 429, the elastic member 419 will return to its original oval shape by its own resiliency.

Thus, the cosmetic packages 1, 100 both include a two-step lock to secure the plurality of applicators 10, 410 with the base 2, 200. In the first step, the plurality of caps 13, 413 of the respective plurality of applicators 10, 410 are secured to the respective conical portions 6*c*, 460*c* of the respective neck portions 6, 460 of the cosmetic containers 14, 400 by the respective elastic members 19, 419. In the second step, the pivot frame 30, 300 is brought into its first resting position where the pivot frame 30, 300 covers the plurality of caps 413 at least from a top side without abutting the plurality of caps 13, 413 such that the minuscule gap G is present between the plurality of caps 13, 413 and the pivot frame 30, 300 which prevents the plurality of applicators 10, 410 from being popped out from the respective reservoirs 2*a*, 420 in the base 2, 200, refer FIGS. 3 and 14.

The caps 13, 413 of the cosmetic containers 14, 400 of the present disclosure can be opened by operating on release buttons 25, 429 to provide access to reservoirs 2*a*, 420 of the cosmetic containers 14, 400 and cosmetic products held therein. The cosmetic containers 14, 400 are thus easily opened by pushing the release buttons 25, 429. Persons for whom a large diameter threaded cap and container might present a challenge are able to use the present cosmetic containers 14, 400 without difficulty. The pivot frame 30, 300 further prevents inadvertent release of the release buttons 25, 429 by securing the caps 13, 413 of the cosmetic containers 14, 400 in the closed position even if the release buttons 25, 429 are not holding the respective caps 13, 413 in the closed position.

According to various example aspects, the pivot frame 30, 300 and the collar 5, 450 may be constructed from a metal, ceramic, glass, and/or a plastic material including but not limited to, acrylic, polyvinyl chloride and polyethylene, polypropylene, polycarbonate, acrylonitrile butadiene styrene, styrene-acrylonitrile, polymers of cyclohexanedimethanol terephthalic acid (PCTA), polyoxymethylene, nylon, rubber, synthetic rubber, silicone, neoprene, santoprene, thermoplastic rubber, thermoplastic elastomer and combinations thereof. The material may be opaque or clear.

According to alternate embodiments (not shown) of the present disclosure, instead of the pivot frame 300, a removable cover may be provided to cover at least a top side of the base 200.

In yet alternate embodiments, the cap of the applicator and the neck portion of a cosmetic container may be removably engaged with each other through threads, snap-fitment or by any other means known in the art.

In certain example aspects, the cosmetic package 1, 100 may have a cosmetic of one type and/or color in one reservoir 2*a*, 420 and a cosmetic of a different type and/or color in the other reservoir 2*a*, 420.

The foregoing description, for purposes of explanation, has been described with reference to specific examples. However, the illustrative discussions above are not intended to be exhaustive or to limit the disclosure to the precise forms disclosed. Many modifications and variations are possible in view of the above teachings. The examples were chosen and described in order to best explain the principles of the disclosure and its practical applications, to thereby enable others skilled in the art to best utilize the disclosure and various examples with various modifications as may be suited to the particular use contemplated.

What is claimed is:

1. A cosmetic package comprising:

a base with a plurality of reservoirs;

a pivot frame secured to the base;

a plurality of applicators, wherein each applicator of the plurality of applicators is removably attached to a respective reservoir of the plurality of reservoirs;

wherein each of the plurality of reservoirs accommodates a cosmetic or a care product;

wherein each of the plurality of applicators comprises a rod, a cap at a proximal end of the rod and an applicator tip at a distal end of the rod;

wherein the cap includes at least one sidewall and a radial through hole formed in the at least one sidewall;

wherein a release button is slidably received and located within the radial through hole formed in the at least one sidewall of the cap;

wherein the at least one sidewall of the cap, that receives the release button, is always exposed to an external environment;

wherein the release button and a portion of the at least one sidewall of the cap, that receives the release button, are not configured to be covered by the pivot frame;

wherein when the cap is secured to a respective reservoir of the plurality of reservoirs, the cap is completely positioned outside said respective reservoir while the applicator tip is positioned inside said respective reservoir;

wherein the pivot frame is configured to have a closed position and at least one open position;

wherein in the open position of the pivot frame, the pivot frame is at a non-zero degree angle with respect to a vertical axis of the base;

wherein in the open position of the pivot frame, each of the plurality of applicators can be disengaged from a respective reservoir of the plurality of reservoirs by pushing in a release button present in the respective cap;

wherein in the closed position of the pivot frame, the pivot frame is at a zero degree angle with respect to the vertical axis of the base and prevents the plurality of applicators from disengaging from the plurality of reservoirs of the base; and wherein in the closed position of the pivot frame, the pivot frame covers the caps of the plurality of applicators from at least a top side of the caps without abutting the caps such that there is a minuscule gap between the caps and the pivot frame which prevents the plurality of applicators from accidentally popping out from the plurality of reservoirs by restricting an axial movement of the plurality of applicators in an upward direction.

2. The cosmetic package according to claim 1, wherein at least two cosmetic products housed in respective ones of the plurality of reservoirs are different from each other and/or at least two applicators of the plurality of the applicators housed in respective ones of the plurality of reservoirs are different from each other.

3. The cosmetic package according to claim 1, wherein the plurality of reservoirs has a plurality of neck portions; wherein the plurality of neck portions is formed by a collar that is fitted to a proximal end of the plurality of reservoirs; and wherein each of the plurality of the neck portions of the collar fits over a respective opening of each of the plurality of reservoirs.

4. The cosmetic package according to claim 3, wherein each of the caps comprises a cap body adapted to be detachably fitted around the plurality of neck portions of the collar, and wherein the cap body houses a spring and an elastic member, and wherein the release button is integral with the elastic member.

5. The cosmetic package according to claim 4, wherein the elastic member has an oval shape which engages with a conical portion of the plurality of the neck portions of the collar for keeping the cap body from coming off the base, and wherein when the release button is pushed in by pressing, the elastic member is deformed into a circular shape having a larger diameter than a diameter of a cylindrical rim portion of the respective neck portion of the plurality of the neck portions of the collar and disengages from the conical portion of the respective neck portion of the collar.

6. The cosmetic package according to claim 5, wherein when the release button is pushed in, the cap is spontaneously pushed up by a force of the spring.

7. The cosmetic package according to claim 1, wherein the plurality of reservoirs of the base is identical and regularly spaced from the plurality of reservoirs while extending parallel to one another.

8. The cosmetic package according to claim 1, wherein the pivot frame rotates at least 60 degrees but less than 180 degrees with respect to the vertical axis of the base.

9. The cosmetic package according to claim 1, wherein the pivot frame includes a back wall, a top wall, a left sidewall and a right sidewall.

10. The cosmetic package according to claim 9, wherein the pivot frame is rotatably attached to the base through a pair of recesses and a pair of protrusions, and wherein inner surfaces of the left sidewall and the right sidewall of the pivot frame include the pair of recesses that mate with the corresponding pair of protrusions on outer surfaces of an upper left edge and an upper right edge of the base.

11. The cosmetic package according to claim 10, wherein the cosmetic package is configured to allow the pivot frame to rest about at least two different angular positions with respect to the base, and wherein the base includes a pair of projections on outer surfaces of both an upper left edge and an upper right edge of the base, and the pivot frame includes a pair of bumps on the inner surfaces of the left sidewall and the right sidewall of the pivot frame.

12. The cosmetic package according to claim 11, wherein when in a first resting position of the pivot frame, the pivot frame is at a zero degree angle with respect to the vertical axis of the base and corresponds to the closed position of the pivot frame, and wherein in a second resting position, the pivot frame is at a non-zero degree angle with respect to the vertical axis of the base and corresponds to the open position of the pivot frame.

13. A cosmetic package comprising:

a base;

a pivot frame secured to the base;

a plurality of cosmetic containers removably secured to the base;

wherein each of the plurality of cosmetic containers includes a reservoir;

wherein at least one of the plurality of cosmetic containers includes a corresponding applicator associated with said reservoir;

wherein the reservoir accommodates a cosmetic or a care product;

wherein the applicator comprises a rod, a cap at a proximal end of the rod and an applicator tip at a distal end of the rod;

wherein the cap includes at least one sidewall and a radial through hole formed in the at least one sidewall;

wherein a release button is slidably received and located within the radial through hole formed in the at least one sidewall of the cap;

wherein the at least one sidewall of the cap, that receives the release button, is always exposed to an external environment;

wherein the release button and a portion of the at least one sidewall of the cap, that receives the release button, are not configured to be covered by the pivot frame;

wherein when the cap is secured to the reservoir, the cap is completely positioned outside the reservoir while the applicator tip is positioned inside the reservoir;

wherein the pivot frame is configured to have a closed position and at least one open position;

wherein in the open position of the pivot frame, the pivot frame is at a non-zero degree angle with respect to a vertical axis of the base;

wherein in the open position of the pivot frame, the applicator can be disengaged from the respective reservoir by pushing in the release button present in the cap; and wherein in the closed position of the pivot frame, the pivot frame covers the cap of the applicator from at least a top side of the cap without abutting the cap such that there is a minuscule gap between the cap and the pivot frame which prevents the applicator from accidentally popping out from the reservoir by restricting an axial movement of the applicator in an upward direction.

14. The cosmetic package according to claim 13, wherein the base includes a vertically extending back wall, a left sidewall and a right sidewall extending substantially perpendicularly from a front surface of the back wall of the base; and wherein the front face of the back wall of the base further includes a plurality of partition walls extending substantially perpendicularly therefrom; and wherein spaces between adjacent partition walls of the plurality of partition walls define receiving openings for holding the plurality of cosmetic containers in the base.

15. The cosmetic package according to claim 14, wherein the reservoir of each of the plurality of cosmetic containers include a least two opposing recesses on two opposing sidewalls of the reservoir, and wherein the at least two opposing recesses on the two opposing sidewalls of the reservoir are dimensioned to receive the two adjacent partition walls of the base when a cosmetic container of the plurality of the cosmetic containers is inserted into the respective receiving opening provided in the base.

16. The cosmetic package according to claim 15, wherein each of the plurality of partition walls are provided with snap protrusions on an upper edge and a lower edge thereof; and wherein the reservoir of each of the plurality of cosmetic containers is provided with corresponding snap grooves in the two opposing recesses at an upper edge and a lower edge of the reservoir; and wherein the snap grooves is configured to mate with the snap protrusions of the plurality of the partition walls of the base for establishing a readily attachable and detachable snap-connection between the plurality of cosmetic containers and the base.

17. The cosmetic package according to claim 13, wherein the cap comprises a cap body adapted to be detachably fitted around a respective neck portion of the respective cosmetic container, and wherein the cap body houses a spring and an elastic member, and wherein the release button is integral with the elastic member, and wherein the release button is slidably received in a radial through hole formed in at least one sidewall of the cap body.

18. The cosmetic package according to claim 17, wherein the elastic member has an oval shape which engages with a conical portion of a respective neck portion of the respective cosmetic container for keeping the cap body from coming off the base, and wherein when the release button is pushed in by pressing, the elastic member is deformed into a circular shape having a larger diameter than the diameter of a cylindrical rim portion of the respective neck portion and disengages from the conical portion of the respective neck portion.

19. A cosmetic package comprising:

a base having at least one reservoir;

a pivot frame rotatably secured to the base;

a cap removably attached to a neck portion of the at least one reservoir to seal the at least one reservoir in a closed state;

wherein the cap can be detached from the neck portion of the at least one reservoir by pushing a release button provided in the cap;

wherein the cap includes at least one sidewall and a radial through hole formed in the at least one sidewall;

wherein a release button is slidably received and located within the radial through hole formed in the at least one sidewall of the cap;

wherein the at least one sidewall of the cap, that receives the release button, is always exposed to an external environment;

wherein the pivot frame includes a top wall, a left sidewall and a right sidewall; and wherein the left sidewall and the right sidewall extend downwardly from the top wall of the pivot frame;

wherein the pivot frame is configured to have a closed position and at least one open position;

wherein in the closed position of the pivot frame, the pivot frame is at a zero degree angle with respect to a vertical axis of the base and prevents the cap from dislodging from the at least one reservoir of the base;

wherein in the at least one open position of the pivot frame, the pivot frame is at a non-zero degree angle with respect to the vertical axis of the base;

wherein in the at least one open position of the pivot frame, the cap can be removed from the at least one reservoir of the base; and wherein in the closed position of the pivot frame, the top wall of the pivot frame covers the cap from at least a top side of the cap without abutting the cap such that there is a minuscule gap between the cap and the pivot frame which restricts an upward axial movement of the cap.

20. The cosmetic package according to claim 19, wherein the cap is attached to a proximal end of a rod and an applicator tip is secured at a distal end of the rod; and wherein when cap is engaged to the at least one reservoir the applicator tip dips into the reservoir.

* * * * *